United States Patent [19]

Okazaki et al.

[11] Patent Number: 4,513,081

[45] Date of Patent: Apr. 23, 1985

[54] SILVER HALIDE PHOTOGRAPHIC EMULSION

[75] Inventors: Masaki Okazaki; Osami Tanabe; Satoshi Nagaoka; Yuji Mihara; Keizo Kimura; Makoto Umemoto, all of Kanagawa, Japan

[73] Assignee: Fuji Photo Film Co., Ltd., Japan

[21] Appl. No.: 612,497

[22] Filed: May 21, 1984

[30] Foreign Application Priority Data

May 19, 1983 [JP] Japan ..... 58-88081

[51] Int. Cl.[3] ..... G03C 7/26

[52] U.S. Cl. ..... 430/550; 430/552; 430/553; 430/572; 430/592

[58] Field of Search ..... 430/550, 552, 553, 572, 430/592

[56] References Cited

U.S. PATENT DOCUMENTS

| | | | |
|---|---|---|---|
| 2,493,748 | 1/1950 | Brooker et al. | 430/577 |
| 3,384,486 | 5/1968 | Taber et al. | 430/550 |
| 4,002,480 | 1/1977 | Hinata et al. | 430/550 |
| 4,427,767 | 1/1984 | Aoki et al. | 430/553 |
| 4,455,367 | 6/1984 | Seoka et al. | 430/553 |

*Primary Examiner*—J. Travis Brown
*Attorney, Agent, or Firm*—Sughrue, Mion, Zinn, Macpeak, and Seas

[57] ABSTRACT

A silver halide photographic emulsion is described containing in combination at least one sensitizing dye represented by formula (I) and at least one cyan coupler represented by formula (II):

(I)

(II)

wherein all the symbols are defined in the specification.

In a preferred embodiment, in addition to the sensitizing dye (I) and the cyan coupler (II), there may also be included at least one compound represented by formula (III)

(III)

wherein all the symbols are also defined in the specification.

9 Claims, No Drawings

SILVER HALIDE PHOTOGRAPHIC EMULSION

FIELD OF THE INVENTION

This invention relates to a spectrally sensitized silver halide color photographic emulsion, and, more particularly, to a red-sensitive silver halide color photographic emulsion which prevents desensitization caused by mutual action between a coupler and a spectrally sensitizing dye.

BACKGROUND OF THE INVENTION

The spectral sensitizing technique of adding a certain sensitizing dye to a silver halide photographic emulsion to expand its light-sensitive wavelength region to the longer wavelength side is well known and employed for preparing silver halide photographic emulsions.

The degree of spectral sensitization is influenced by the chemical structure of the sensitizing dye, properties of the emulsion (for example, composition of silver halides, crystal habit, crystal form, silver ion concentration, hydrogen ion concentration, etc.), and the like.

This spectral sensitivity is also influenced by photographic additives copresent in the emulsion, such as a stabilizer, an antifoggant, a coating aid, a flocculating agent, a color coupler, etc.

p-Phenylenediamine type color couplers as represented by formula (II) to be shown hereinafter are known to produce cyan dyes having excellent resistance against fading upon heating in dark room. However, the use of the color coupler sometimes fails to fully remove desensitization due to mutual action with conventional cyanine dyes having one sulfoalkyl group. With cyanine dyes having two sulfoalkyl groups, desensitization is removed, but such cyanine dyes cause an increased sensitization by diffusion into another layer or layers (with light-sensitive materials having at least two layers with spectral sensitivites in different light-sensitive wavelength regions, such as color photographic light-sensitive materials, diffusion of a dye into other layer means unfavorable sensitization with the dye diffused into the other layer, hereinafter this phenomenon is called diffusion sensitization) particularly under high humidity, which is a serious problem in practical use. Thus, it has been a technically important subject to prevent this sensitization by diffusion.

SUMMARY OF THE INVENTION

It is, therefore, an object of the present invention to provide a silver halide emulsion which does not undergo desensitization with a p-phenylenediamine type color coupler represented by formula (II).

Another object of the present invention is to provide a silver halide emulsion which does not undergo diffusion sensitization.

As a result of intensive investigations, it has now been found that the above-described objects can be attained by incorporating at least one compound represented by formula (I) in a silver halide photographic emulsion containing a color coupler represented by formula (II). Furthermore, development fogging can be prevented and a high sensitivity can be obtained by further using at least one compound represented by formula (III) as described below in the silver halide photographic emulsion.

DETAILED DESCRIPTION OF THE INVENTION

The compound of formula (I) is represented by

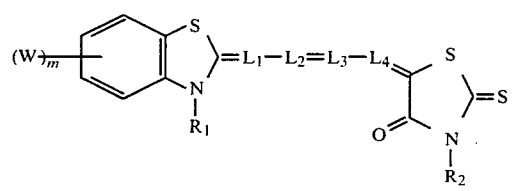

(I)

In formula (I), W represents a halogen atom (e.g., a fluorine atom, a chlorine atom, a bromine atom or an iodine atom), an unsubstituted or substituted alkyl group (e.g., a methyl group, an ethyl group, a phenethyl group, etc.), an unsubstituted or substituted aryl group (e.g., a phenyl group, etc.), a hydroxyl group, an unsubstituted or substituted alkoxy group (e.g., a methoxy group, an ethoxy group, an n-butoxy group, etc.), an unsubstituted or substituted aryloxy group (e.g., a phenoxy group, etc.), an acyl group (e.g., an acetyl group, a propionyl group, etc.), an acyloxy group (e.g., an acetyloxy group, a propionyloxy group, etc.), an unsubstituted or substituted alkoxycarbonyl group (e.g., a methoxycarbonyl group, an ethoxycarbonyl group, etc.), a carbamoyl group, a sulfamoyl group, a carboxyl group, or an unsubstituted or substituted benzo group (e.g., a 4,5-benzo group, a 5,6-benzo group, a 6,7-benzo group, etc.). Where W represents a group containing carbon atoms, it preferably contains 10 or less carbon atoms. Preferably W represents an electron donative group such as a methyl group or a methoxy group, with a 5-methyl group, a 6-methyl group, or a 5,6-dimethyl group being more preferable.

$L_1$, $L_2$, $L_3$, and $L_4$ each represents an unsubstituted methine group (—CH=), a substituted methine group, which may be substituted by an alkyl group (including substituted ones), an acetyl group, an alkoxy group, a thioalkoxy group, an aryl group or the like and, where carbon atoms are contained, 8 or less carbon atoms are preferably contained; for example, $-C(CH_3)=$, $-C(C_2H_5)=$, $-C(CH_2CH_2COOH)=$, $-C(CH_2CH_2CH_2OH)=$, $-C(CH_2CH_2CH_3)=$, $-C(COCH_3)=$, $-C(OC_2H_5)=$, $-C(SC_2H_5)=$,

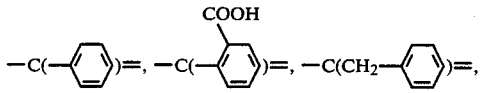

etc.; or, $L_2$ and $L_4$ may be connected to each other to form a ring via 2 to 3 methylene units or substituted methylene units (for example,

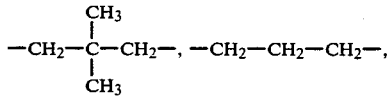

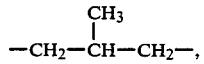

$-CH_2CH_2-$, etc.), with $-C(CH_3)=$, $-C(C_2H_5)=$, and

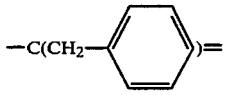

being preferable, and $L_2$ and $L_4$ being optionally connected to each other to form a ring through

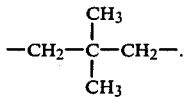

$R_1$ represents an unsubstituted alkyl group containing preferably 10 or less carbon atoms, e.g., a methyl group, an ethyl group, an n-propyl group, an n-butyl group, an n-amyl group, an n-hexyl group, an n-heptyl group, an n-octyl group, etc.); or a substituted alkyl group (containing preferably 10 or less carbon atoms, e.g., a vinylmethyl group, a 2-hydroxyethyl group, a 4-hydroxybutyl group, a 2-acetoxyethyl group, a 3-acetoxypropyl group, a 2-methoxyethyl group, a 4-methoxybutyl group, a 2-carboxyethyl group, a 3-carboxypropyl group, a p-carboxybenzyl group, a 2-sulfoethyl group, a 3-sulfopropyl group, a 3-sulfobutyl group, a 4-sulfobutyl group, a 2-hydroxy-3-sulfopropyl group, a p-sulfophenethyl group, a p-sulfobenzyl group, etc.); with an unsubstituted alkyl group being preferable, and an unsubstituted alkyl group containing 4 to 7 carbon atoms being particularly preferable.

$R_2$ represents an aryl group (containing preferably 10 or less carbon atoms, e.g., a phenyl group, a naphthyl group, etc.); a substituted aryl group (containing preferably 10 or less carbon atoms, e.g., a tolyl group, a p-chlorophenyl group, a m-carboxyphenyl group, a p-carbethoxyphenyl group, etc.); a heterocyclic group (e.g., a 2-pyridyl group, a 4-pyridyl group, a furfuryl group, a thienyl group, a 2-thiazolyl group, etc.); as well as the alkyl or substituted alkyl group defined with respect to $R_1$. A particularly preferable example of $R_2$ is a carboxymethyl group. However, at least one of $R_1$ and $R_2$ represents a substituted alkyl group containing a sulfo or carboxyl group.

"m" represents 0, 1 or 2. When m represents 2, two W may represent the same or different group from each other.

The color coupler of formula (II) is represented by

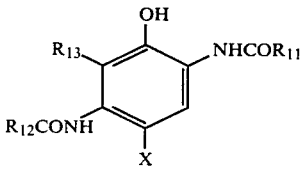

(II)

In the above formula (II), $R_{11}$ and $R_{12}$ each represents an alkyl group, an aryl group, a heterocyclic group, an alkyloxy group, an aryloxy group, a heterocyclyloxy group, an alkylamino group, an arylamino group or a heterocyclylamino group; $R_{13}$ represents a hydrogen atom, a halogen atom, an alkyl group, an aryl group, an alkoxy group, an aryloxy group, an acyloxy group or an acylamino group; X represents a group capable of being eliminated upon oxidative coupling reaction with a developing agent; or $R_{12}$ and $R_{13}$ may be connected to each other to form a 5- or 6-membered ring.

$R_{11}$, $R_{12}$, $R_{13}$, and X in formula (II) are described in detail below.

$R_{11}$ and $R_{12}$ each contains preferably up to 32 carbon atoms and represents a chained or cyclic alkyl group (e.g., a methyl group, a butyl group, a cyclohexyl group, a dodecyl group, etc.), an aryl group (e.g., a phenyl group, a naphthyl group, etc.), a heterocyclic group (e.g., a 2-pyridyl group, a 2-furfuryl group, a 2-benzothiazolyl group, etc.), an alkyloxy group (e.g., a methoxy group, a dodecyloxy group, etc.), an aryloxy group (e.g., a phenoxy group, a naphthyloxy group, etc.), a heterocyclyloxy group (e.g., a 4-pyridyloxy group, an 8-quinolyloxy group, etc.), an alkylamino group (e.g., a butylamino group, a dimethylamino group, a dodecylamino group, etc.), an arylamino group (e.g., an anilino group, a naphthylamino group, an N-methylanilino group, etc.) or a heterocyclylamino group (e.g., a 2-pyridyl group, an imidazolyl group, a pyrazolyl group, a thiazolyl group, a benzothiazolyl group, etc.), which may be substituted by a substituent or substituents selected from among an alkyl group, an aryl group, a heterocyclic group, an alkoxy group (e.g., a methoxy group, a 2-methoxyethoxy group, etc.), an aryloxy group (e.g., a phenoxy group, a 2,4-di-tert-amylphenoxy group, a 2-chlorophenoxy group, etc.), a carboxy group, a carbonyl group (e.g., an acetyl group, a benzoyl group, etc.), an ester group (e.g., a methoxycarbonyl group, a phenoxycarbonyl group, an acetoxy group, a benzoyloxy group, a butoxysulfonyl group, a toluenesulfonyloxy group, etc.), an amido group (e.g., an acetylamino group, an ethylcarbamoyl group, a dimethylcarbamoyl group, a methanesulfonamido group, a butylsulfamoyl group, etc.), a sulfonamido group (e.g., a dipropylsulfamoylamino group, etc.), an imido group (e.g., a succinimido group, a hydantoinyl group, etc.), a ureido group (e.g., a phenylureido group, a dimethylureido group, etc.), a sulfonyl group (e.g., a methanesulfonyl group, etc.), a phosphoric acid amido group (e.g., a diethyl phosphate monoamido group, a tetramethyl phosphate triamido group, etc.), a hydroxy group, a cyano group, a nitro group, a halogen atom, a thio group (e.g., an ethylthio group, a phenylthio group, etc.), and the like.

Also in formula (II), $R_{13}$ represents a hydrogen atom, a halogen atom (e.g., a fluorine atom, a chloride atom, a bromine atom, etc.), an alkyl group containing up to 20 carbon atoms (e.g., a methyl group, a butyl group, a dodecyl group, etc.), an aryl group (e.g., a phenyl group, etc.), an alkoxy group (e.g., a methoxy group, a butoxy group, etc.), an aryloxy group (e.g., a phenoxy group, etc.), an acyloxy group (e.g., an acetoxy group, a benzoyloxy group, etc.), or an acylamino group (e.g., an acetylamino group, a benzoylamino group, etc.), which may be substituted by the foregoing substituents or substituents referred to as substituents for $R_{11}$ or $R_{12}$, or $R_{12}$ and $R_{13}$ may be connected to each other to form a 5- or 6-membered ring.

Further in formula (II), X represents a hydrogen atom, a halogen atom (e.g., a fluorine atom, a chlorine atom, a bromine atom, etc.), or a coupling-off group such as an alkoxy group (e.g., an ethoxy group, a dodecyloxy group, a methoxyethylcarbamoyl group, a carboxymethoxy group, a methylsulfonylethoxy group, etc.), an aryloxy group (e.g., a phenoxy group, a naphthyloxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), a thio group (e.g., a phenylthio group, a tetrazolylthio group, etc.), an imido group (e.g., a succinimido group, a hydantoinyl group, etc.), an azo group (e.g., a phenylazo group, etc.), etc., which may contain a photographically useful group or groups.

Preferable examples of $R_{11}$ in formula (II) include an alkyl group, an aryl group, an arylamino group or a heterocyclylamino group, which may be substituted, with a substituted or unsubstituted phenyl group, a heterocyclylamino group, and a substituted arylamino group being particularly preferable. These groups may be further substituted by the foregoing substituent or substituents referred to with respect to $R_{11}$ or $R_{12}$.

Preferable examples of $R_{12}$ in formula (II) include an alkyl group, an aryl group, an alkyloxy group, an alkylamino group, an arylamino group, and a heterocyclylamino group, which may be substituted. These groups may optionally be further substituted by the foregoing substituent or substituents referred to with respect to $R_{11}$ or $R_{12}$.

Preferable examples of $R_{13}$ in formula (II) include a hydrogen atom, an alkyl group, an alkoxy group, and an acylamino group, which may be further substituted by the foregoing substituent or substituents referred to with respect to $R_{11}$ or $R_{12}$, $R_{13}$ may form a ring together with $R_{12}$. Particularly preferably, $R_{13}$ represents a hydrogen atom or forms a ring together with $R_{12}$.

Preferable examples of X in formula (II) include a hydrogen atom, a halogen atom (particularly preferably a fluorine atom or a chlorine atom), an alkoxy group, an aryloxy group, an acyloxy group, a sulfonyloxy group, a sulfonamido group, an alkoxycarbonyl group, and a thio group.

Specific examples of the compound represented by formula (I) are illustrated below:

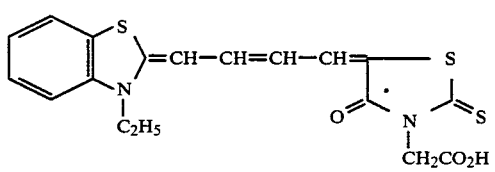
I-1

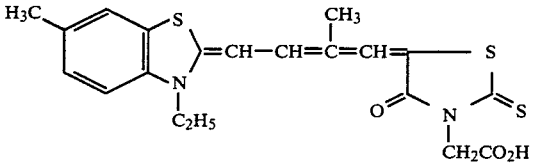
I-2

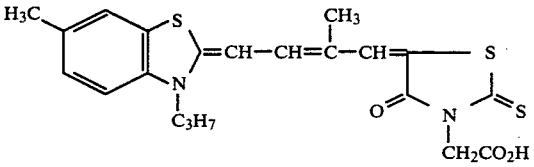
I-3

-continued

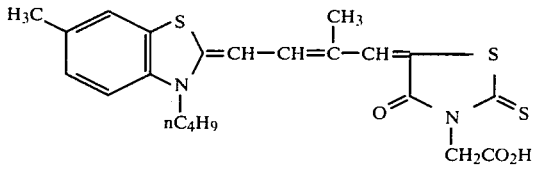
I-4

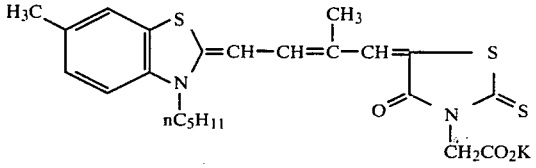
I-5

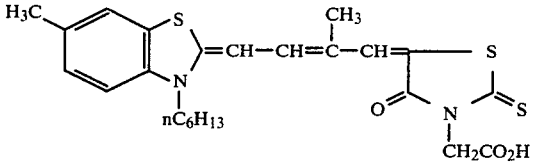
I-6

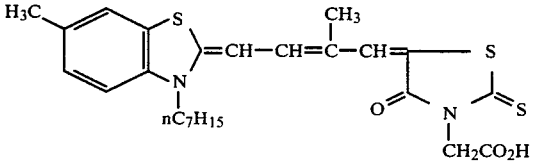
I-7

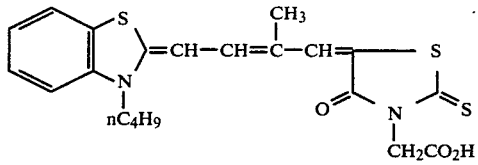
I-8

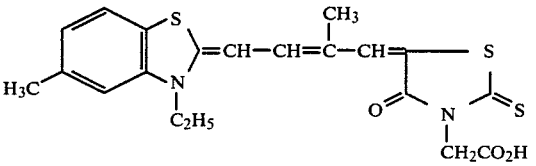
I-9

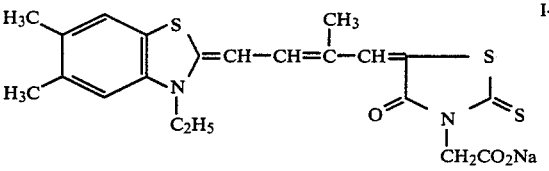
I-10

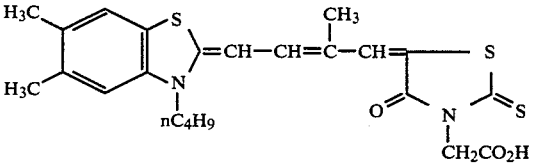
I-11

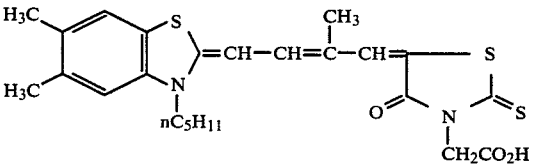
I-12

-continued
I-13
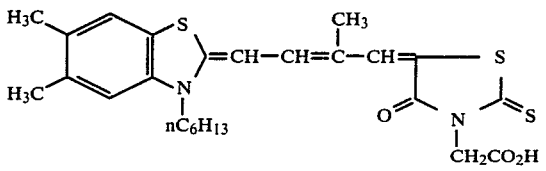
I-14
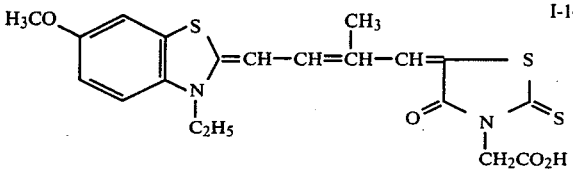
I-15
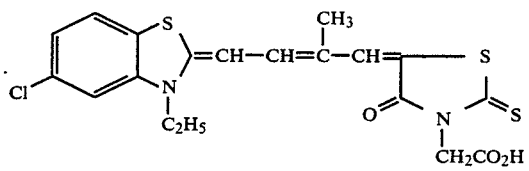
I-16
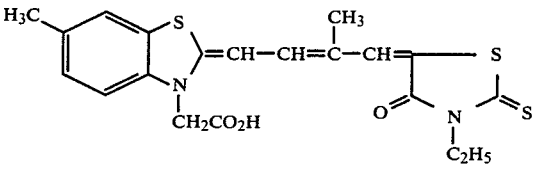
I-17
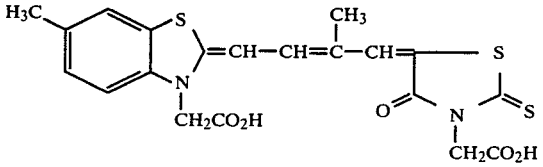
I-18
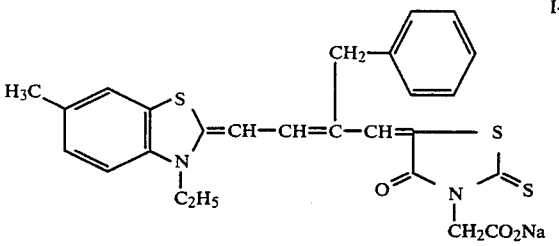
I-19
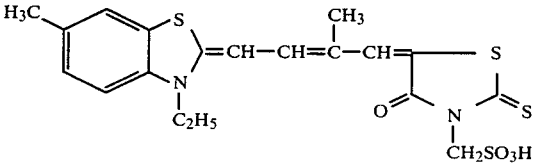
I-20
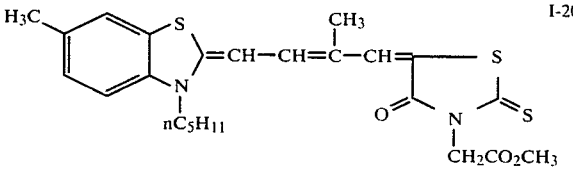
-continued
I-21
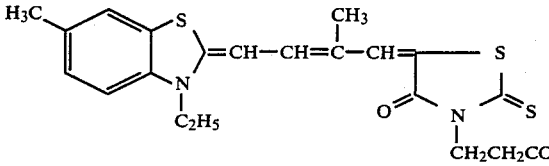
I-22
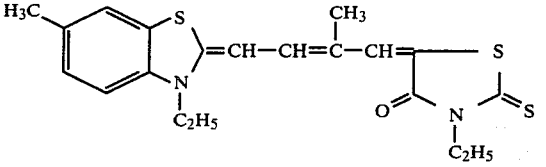
I-23
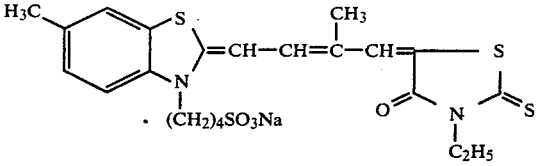
I-24
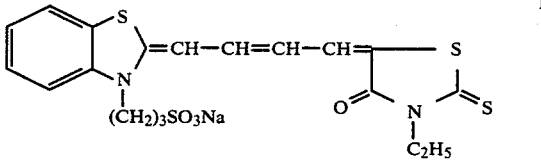
I-25
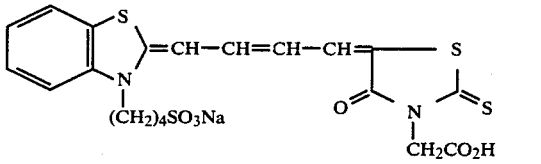
I-26
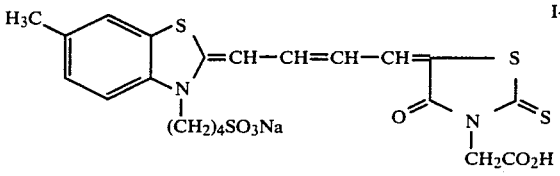
I-27
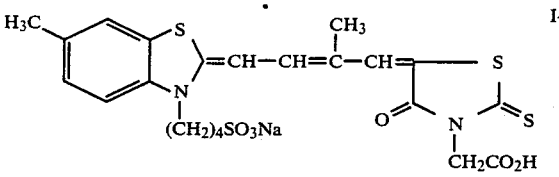
I-28
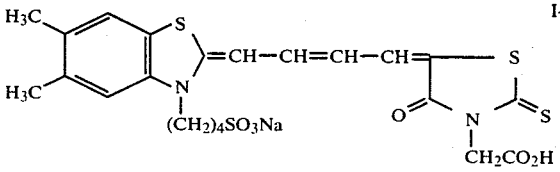
I-29
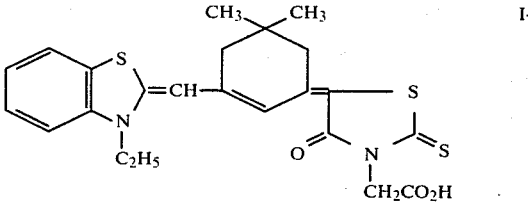

-continued

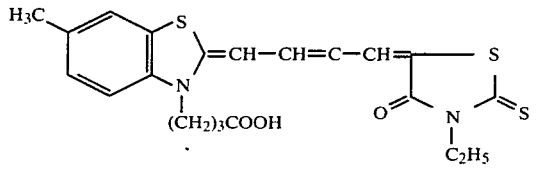

Of the above-described specific examples, I-5, I-6, I-7, I-11, I-12, I-13, I-18 are particularly preferable.

The compounds of the present invention represented by formula (I) can be synthesized by, or according to, the processes described, e.g., in U.S. Pat. Nos. 2,493,747, 2,493,748, etc.

The tetramethinemerocyanine dyes of formula (I) to be used in the present invention are advantageously used in amounts ordinarily employed for spectral sensitization of, for example, about $2\times10^{-5}$ to $2\times10^{-3}$ mol, more preferably about $1\times10^{-5}$ to $2.5\times10^{-4}$ mol, per mol of silver halide in the emulsion.

Addition of the sensitizing dye to the silver halide emulsion is conducted in a conventional manner employed for adding sensitizing dyes. For instance, the sensitizing dye may be directly dispersed in an emulsion, or may be first dissolved in a suitable solvent (for example, methyl alcohol, ethyl alcohol, methyl Cellosolve, acetone, water, pyridine, or a mixture thereof) and then added as a solution to an emulsion. Upon dissolution, ultrasonic vibration may be applied to the system. Also, a method of dissolving a dye in a volatile organic solvent, dispersing the resulting solution in a hydrophilic colloid, and adding the resulting dispersion to an emulsion as described in U.S. Pat. No. 3,469,987, etc., and a method of dispersing a water-insoluble dye in a water-insoluble solvent without dissolution and adding the resulting dispersion to an emulsion as described in Japanese Patent Publication No. 24185/71 may also be employed.

In addition, methods as described in U.S. Pat. Nos. 2,912,345, 2,996,287, 3,342,605, 3,425,835, etc., may be employed for adding the dye to an emulsion.

The tetramethinemerocyanine dye of formula (I) is uniformly dispersed in a finished emulsion before being coated on a suitable support. Of course, the dye may be dispersed in any stage of preparing silver halide emulsion.

Typical specific examples of the coupler represented by formula (II) are illustrated below:

II-1

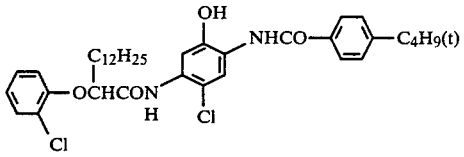

II-2

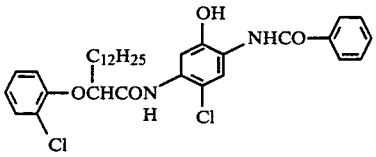

-continued

II-3

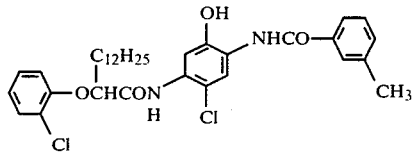

II-4

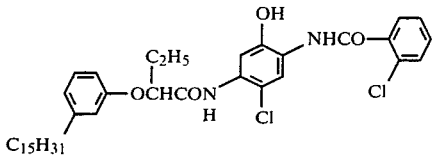

II-5

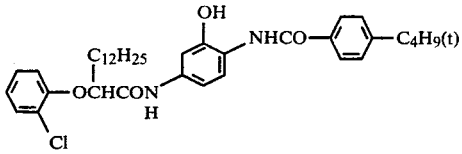

II-6

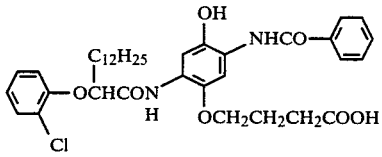

II-7

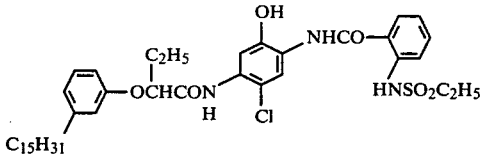

II-8

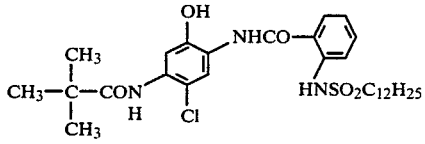

II-9

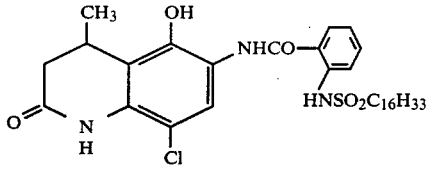

II-10

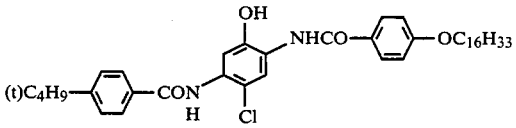

II-11

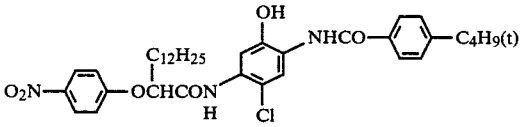

II-12

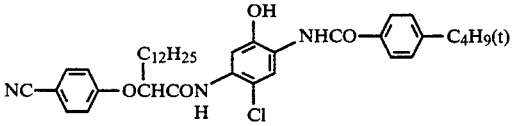

-continued
II-13
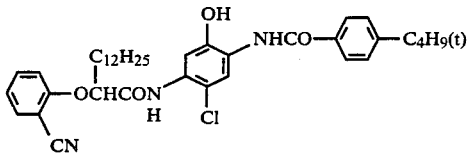
II-14
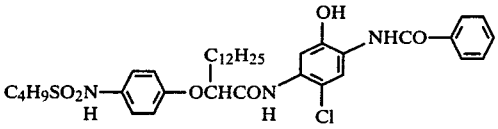
II-15
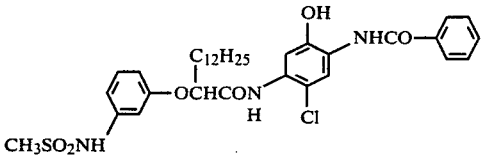
II-16
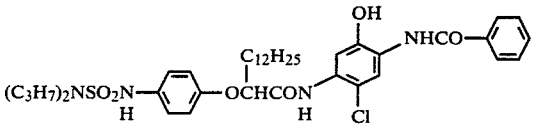
II-17
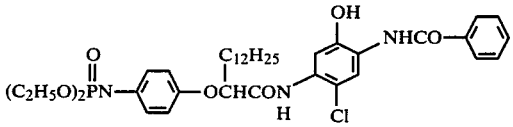
II-18
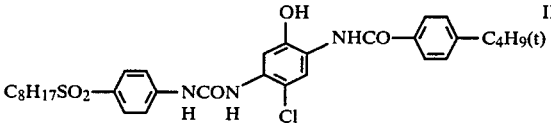
II-19
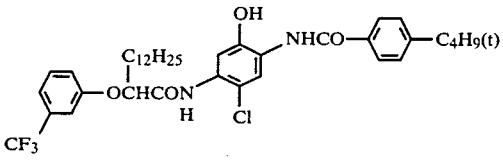
II-20
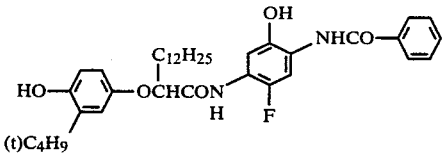
II-21
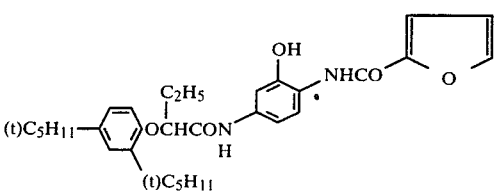
II-22
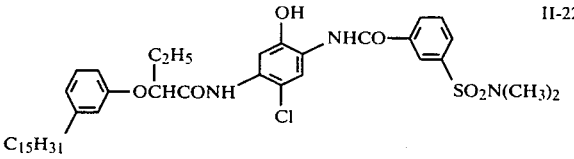
-continued
II-23
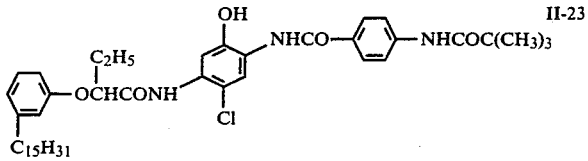
II-24
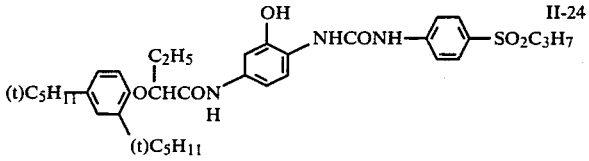
II-25
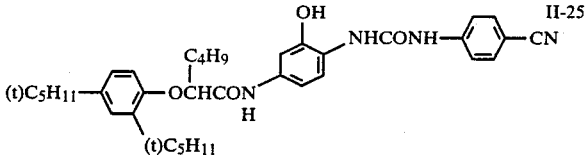
II-26
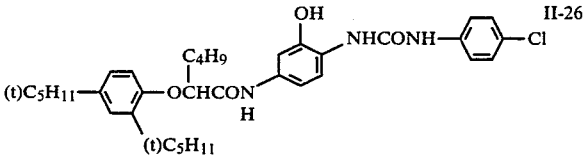
II-27
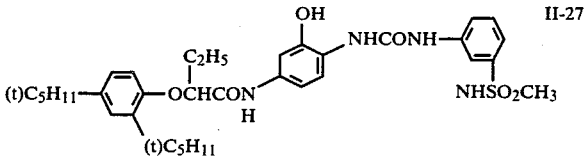
II-28
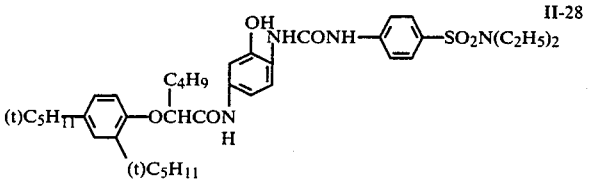
II-29
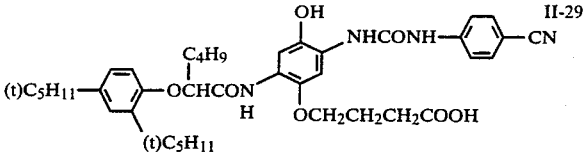
II-30
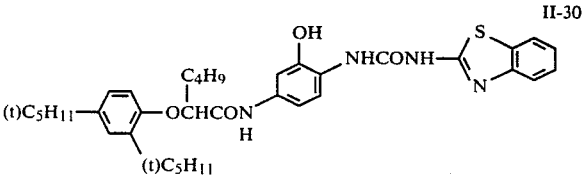
II-31
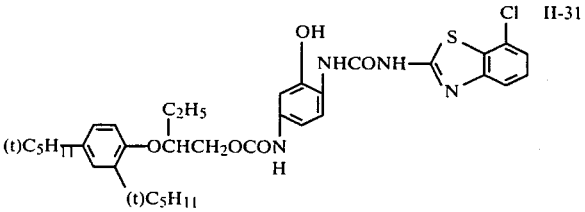

-continued

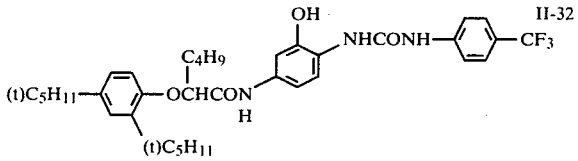
II-32

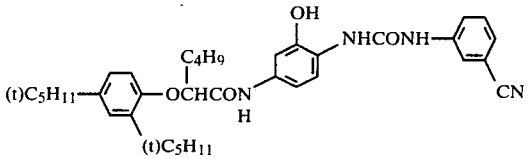
II-33

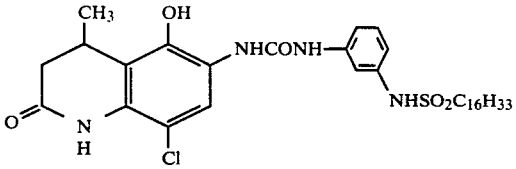
II-34

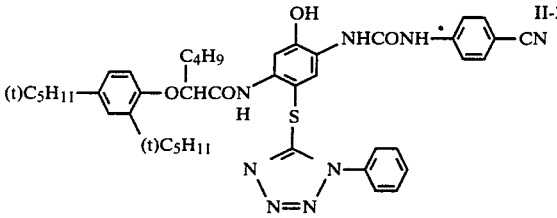
II-35

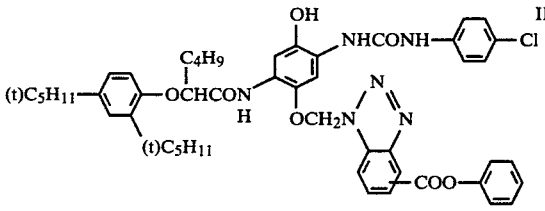
II-36

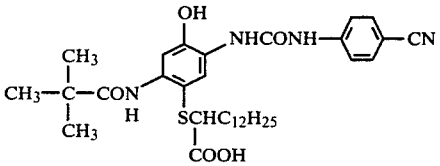
II-37

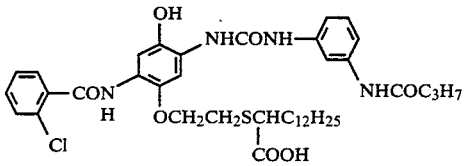
II-38

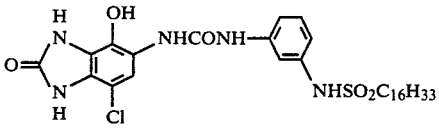
II-39

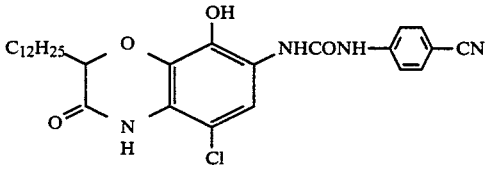
II-40

-continued

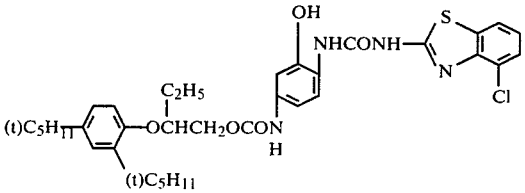
II-41

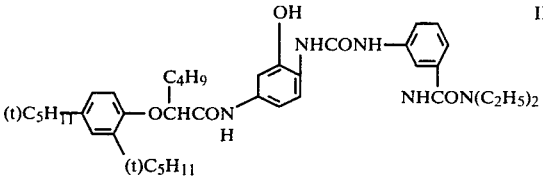
II-42

The cyan couplers of formula (II) to be used in the present invention are advantageously used in an amount of from about $1\times10^{-3}$ to $7\times10^{-1}$ mol, more preferably about $2\times10^{-1}$ to $6\times10^{-1}$ mol, per mol of silver halide in the emulsion.

As the ratio of the tetramethinemerocyanine dye of formula (I) to the cyan coupler of formula (II) (tetramethinemerocyanine dye (I)/cyan coupler (II)), a mol ratio range of from $1/6\times10^4$ to 2/1,000 is advantageously employed.

The cyan couplers of formula (II) to be used in the present invention can be synthesized by a known process according to the following synthesis route:

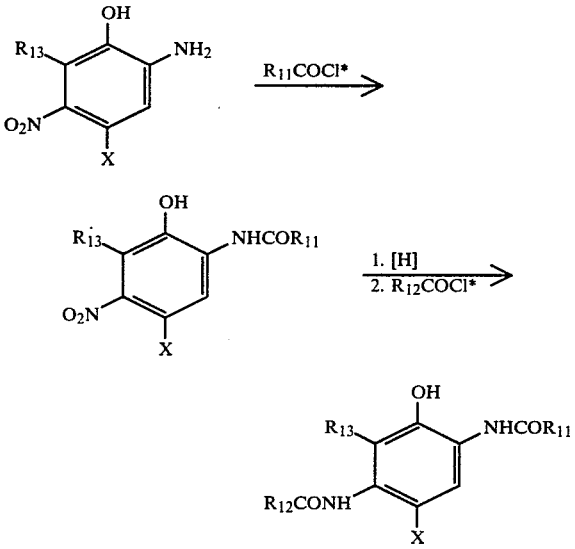

*Where $R_{11}$ and $R_{12}$ represent amino groups, corresponding isocyanates or phenylurethanes may be used.

In the above scheme, $R_{11}$ to $R_{13}$ and X are the same as defined hereinbefore.

The synthesis process is described in detail below by referring to specific examples, however, these do not limit the present invention in any way. Other compounds can be synthesized in an analogous manner.

SYNTHESIS EXAMPLE 1

Synthesis of Illustrative Coupler (II-1)

396 g of 2-amino-4-chloro-5-nitrophenol was suspended in 2.5 liters of acetonitrile, and, while heating under reflux, 418 g of 4-tert-butylbenzoyl chloride was dropwise added thereto over 30 minutes. After heating under reflux for 1 hour, the reaction solution was cooled, and the crystals precipitated were collected by filtration, washed with acetonitrile and dried to obtain 580 g of crystals (mp: 242°–247° C.). The thus obtained crystals were heated under reflux for 1 hour together with 466 g of iron powder, 350 cc of water, 2 liters of isopropanol, and 30 cc of hydrochloric acid.

After removal of the iron powder by filtration, the precipitated crystals were collected by filtration and dried to obtain 480 g of 5-amino-2-(4-tert-butylbenzoylamino)-4-chlorophenol having a melting point of 164°–165° C.

95.7 g of 5-amino-2-(4-tert-butylbenzoylamino)-4-chlorophenol was added to 700 ml of acetonitrile and, while heating under reflux, 4.5 g of 2-(2-chlorophenoxy)tetradecanoyl chloride was dropwise added thereto over 1 hour. After further heating under reflux for 2 hours, 1 liter of ethyl acetate was added thereto, followed by washing with water. After removal of the solvent under reduced pressure, the residue was crystallized from 200 ml of ethyl acetate and 300 ml of acetonitrile. Recrystallization of the resulting crystals gave 152 g of illustrative Coupler (II-1) having a melting point of 111°–113° C.

Elemental Analysis: Found (%): C: 67.62, H: 7.31, N: 4.35. Calculated (%): C: 67.77, H: 7.38, N: 4.27.

SYNTHESIS EXAMPLE 2

Synthesis of Illustrative Coupler (II-24)

37 g of p-propylsulfonylaniline was added to 18 ml of pyridine and 90 ml of acetonitrile and, under cooling with ice, 30.6 g of phenyl chloroformate was dropwise added thereto. After stirring for 2 hours, the reaction solution was poured into ice-water containing 7 ml of hydrochloric acid. The crystals thus precipitated were collected by filtration, washed with aqueous methanol, then dried to obtain 58.2 g of white crystals (mp: 171.5° C.). The thus obtained crystals were suspended in 190 ml of acetonitrile together with 30.3 g of 2-amino-5-nitrophenol and, after adding thereto 2.3 ml of triethylamine, the resulting mixture was heated for 6 hours under reflux. After cooling, the reaction solution was neutralized with hydrochloric acid, and crystals thus precipitated were collected by filtration and washed well with acetonitrile to obtain 58.6 g (dry weight) of yellow crystals.

27 g of the thus obtained crystals were heated for 2 hours under reflux together with 14 g of reduced silver, 1.2 g of ammonium chloride, 1.2 ml of acetic acid, 90 ml of isopropanol, and 15 ml of water. After cooling the reaction solution, 5.7 g of sodium hydroxide dissolved in water was added thereto. After removal of iron powder by filtration, the solution was neutralized with acetic acid, and crystals precipitated were collected by filtration and dried well to obtain 22.8 g of pale red crystals.

13.6 g of the crystals were heated under reflux together with 36 ml of acetonitrile and 4 ml of dimethylacetamide, then 13.5 g of 2-(2,4-di-tert-amylphenoxy)-butanoyl chloride was dropwise added thereto. After heating the solution for 1 hour further under reflux, 70 ml of ethyl acetate was added thereto, followed by washing with water. The solvent was distilled off under reduced pressure, and the residue was recrystallized twice from acetonitrile to obtain 19.8 g of desired Coupler (II-24). mp: 130°–133° C.

Elemental Analysis: Found (%): C: 66.31, H: 7.56, N: 6.30. Calculated (%): C: 66.33, H: 7.58, N: 6.45.

Further regarding couplers to be used in the present invention, not only may the coupler represented by formula (II) be used independently, but also the use of the coupler of formula (II) combined with a known coupler as described hereinafter may be conducted.

When incorporated independently in a silver halide emulsion, tetramethinemerocyanine dyes of formula (I) are liable to cause dye fogging, and the spectral sensitivity obtained thereby is liable to decrease with time. On the other hand, compounds represented by formula (III) scarcely have a spectral absorption in the visible region, but have a strong absorption in the near-ultraviolet region. When the tetramethinemerocyanine dye of the present invention represented by formula (I) is incorporated in a silver halide photographic emulsion together with the compound represented by formula (III), dye fogging is effectively depressed and a decrease of spectral sensitivity with time is substantially prevented with scarcely decreasing spectral sensitivity.

The compound of formula (III) is represented by

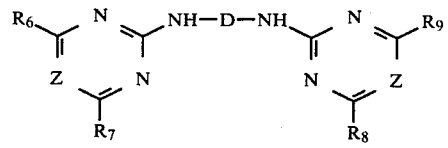

(III)

In the above formula, Z represents —CH= or —N=, and —D— represents a divalent aromatic residue (for example, a monocyclic aromatic nucleus residue, a residue of ring system wherein at least two aromatic nuclei are fused, or a residue wherein at least two aromatic nuclei are connected to each other directly or through an atom or atoms; specifically, biphenyl, naphthylene, stilbene, dibenzyl, etc.), with those represented by $—D_1—$ and $—D_2—$ set forth below being particularly preferable:

$—D_1—$:

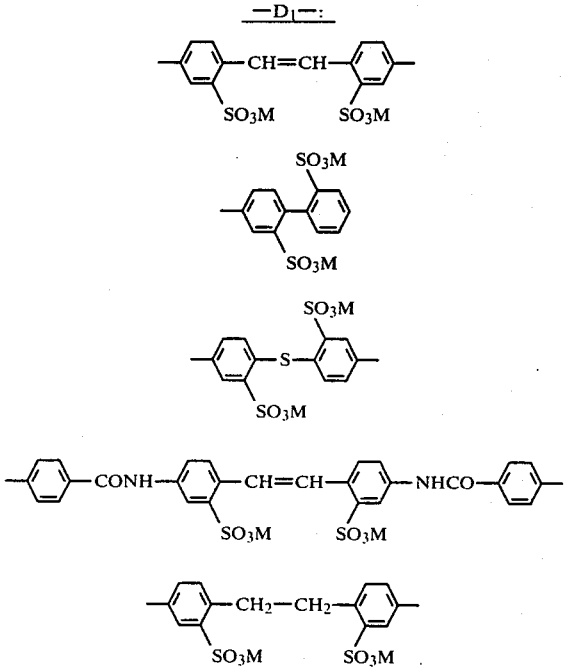

-continued

—$D_1$—:

and

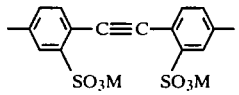

wherein M represents a hydrogen atom or a cation capable of imparting water-soluble properties (e.g., alkali metal ion such as Na ion or K ion, ammonium ion, etc.);

—$D_2$—:

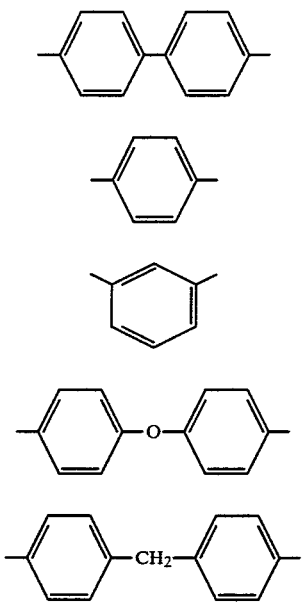

and

-continued

—$D_2$—:

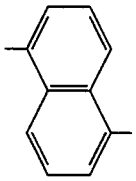

provided that when D represents —$D_2$—, at least one of $R_6$, $R_7$, $R_8$ and $R_9$ has a substituent containing —$SO_3M$.

$R_6$, $R_7$, $R_8$ and $R_9$ each represents a hydrogen atom, a hydroxy group, an alkoxy group (e.g., a methoxy group, an ethoxy group, etc.), an aryloxy group (e.g., a phenoxy group, a naphthoxy group, an o-toluoxy group, a p-sulfophenoxy group, etc.), a halogen atom (e.g., a chlorine atom, a bromine atom, etc.), a heterocyclic group (e.g., a morpholinyl group, a piperidyl group, etc.), a mercapto group, an alkylthio group (e.g., a methylthio group, an ethylthio group, etc.), an arylthio group (e.g., a phenylthio group, a tolylthio group, etc.), a heterocyclythio group (e.g., a benzothiazolylthio group, a benzimidazolylthio group, a phenyltetrazolylthio group, etc.), an amino group, an alkylamino group (e.g., a methylamino group, an ethylamino group, a propylamino group, a dimethylamino group, a diethylamino group, a dodecylamino group, a $\beta$-hydroxyethylamino group, a di-$\beta$-hydroxyethylamino group, a $\beta$-sulfoethylamino group, etc.), a cyclohexylamino group, an arylamino group (e.g., an anilino group, an o-, m- or p-sulfoanilino group, an o-, m- or p-chloroanilino group, an o-, m- or p-anisidino group, an o-, m- or p-toluidino group, an o-, m- or p-carboxyanilino group, a hydroxyanilino group, a sulfonaphthylamino group, an o-, m- or p-aminoanilino group, an o-acetamino-anilino group, etc.), a heterocyclylamino group (e.g., a 2-benzothiazolylamino group, a 2-pyridylamino group, etc.), an aryl group (e.g., a phenyl group, etc.), or an aralkylamino group (e.g., a benzylamino group, etc.). Of the compounds represented by formula (III), those in which at least one of $R_6$ to $R_8$ represents an aryloxy group, an arylamino group, a heterocyclylthio group, or a heterocyclylamino group are particularly preferable.

Specific examples of compounds represented by formula (III) are illustrated below.

III-1

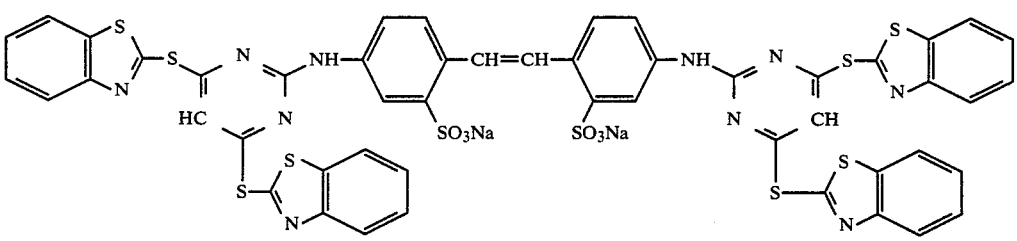

III-2

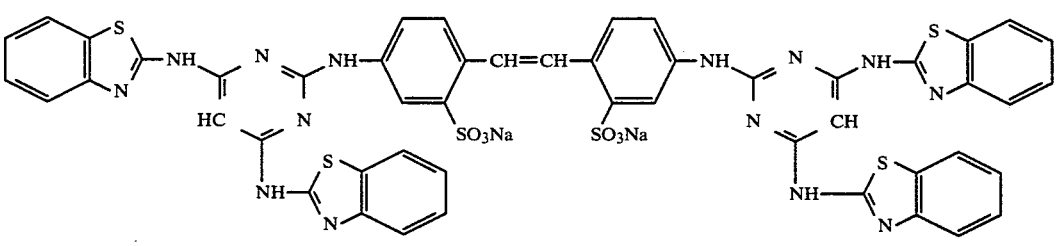

-continued
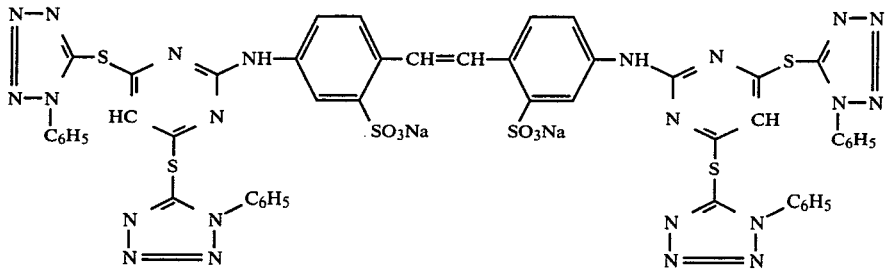
III-3
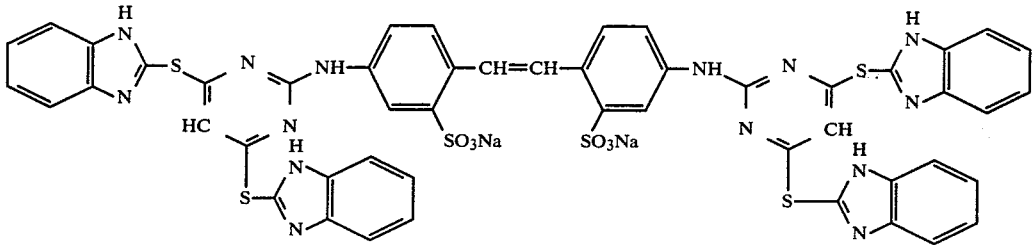
III-4
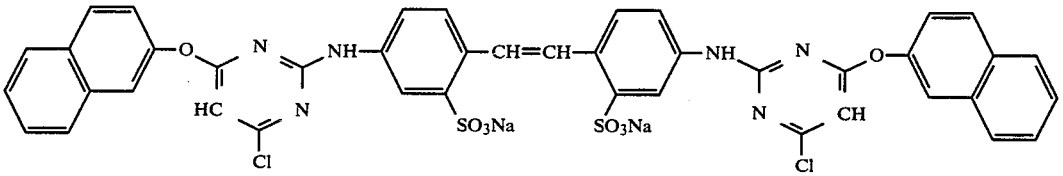
III-5
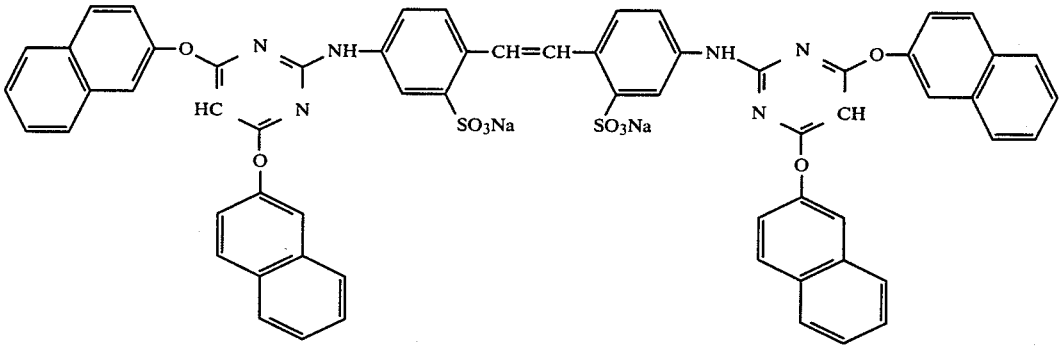
III-6
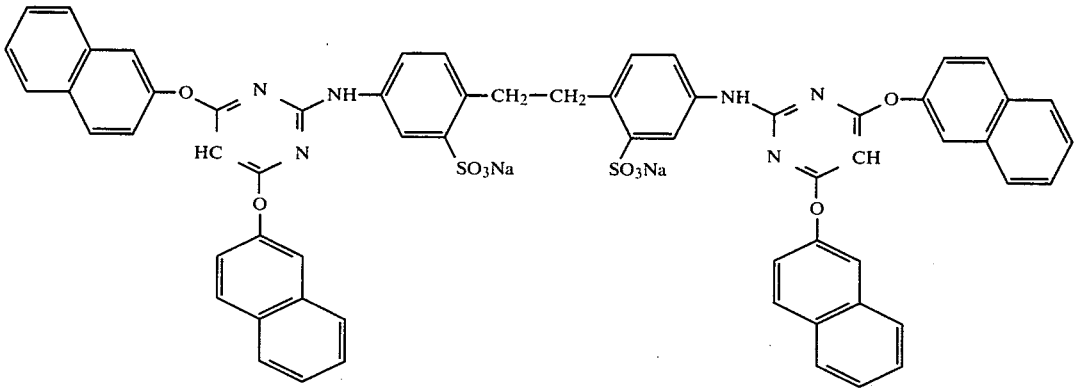
III-7

-continued
III-8
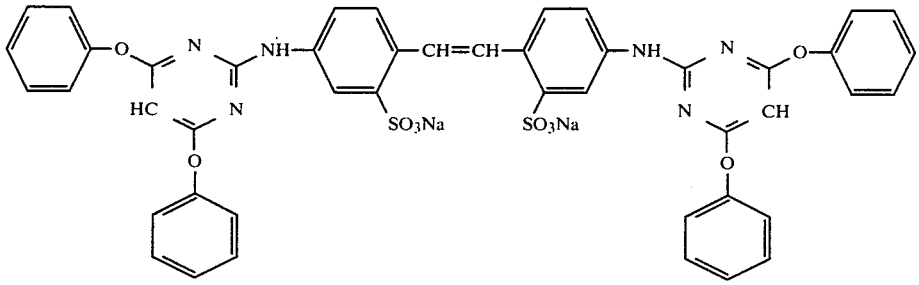
III-9
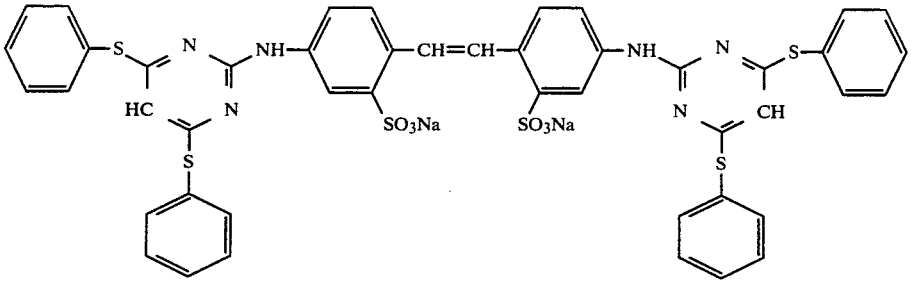
III-10
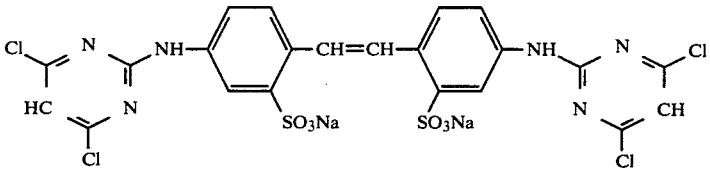
III-11
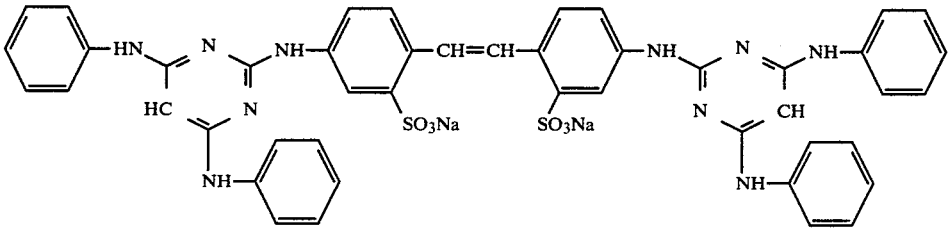
III-12
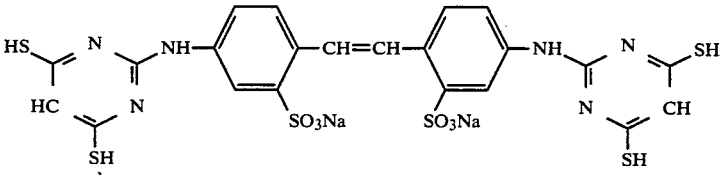
III-13
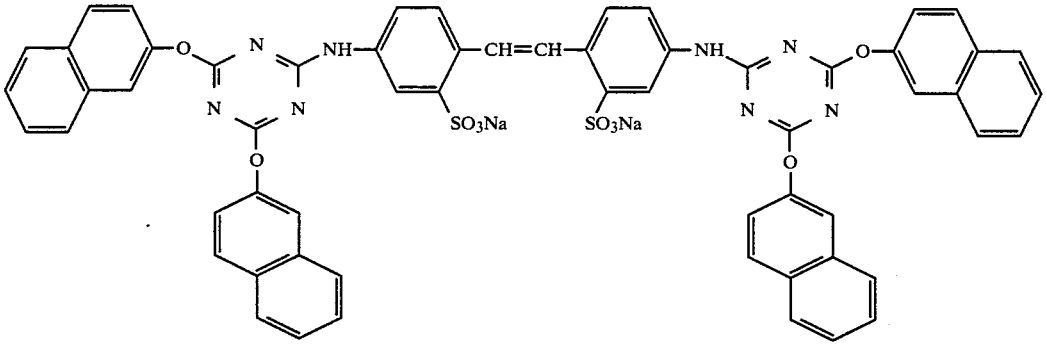

-continued

III-14

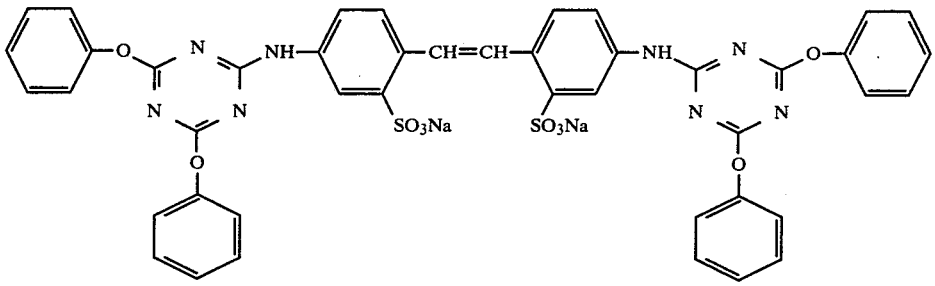

III-15

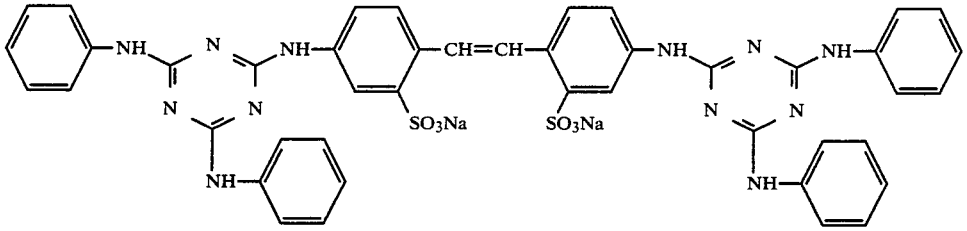

The compounds represented by formula (III) to be used in the present invention can be easily synthesized by those skilled in the art, e.g., by referring to U.S. Pat. No. 3,617,295 (corresponding to Japanese Patent Publication No. 32741/70); others not specifically described therein can be synthesized in an analogous manner.

The compound represented by formula (III) used in the present invention in combination with the tetramethinemerocyanine dye can be used in an amount selected from a wide range, provided it is enough to attain a dye fog-depressing effect, an effect of preventing deterioration of spectral sensitivity with time, and an effect of preventing sensitization by diffusion.

The compound represented by formula (III) to be used in the present invention is advantageously used in an amount of from about 0.01 g to 5 g, more preferably about 0.2 to 4 g, per mol of silver halide in the emulsion.

As the ratio of the tetramethinemerocyanine dye of formula (I) to the compound represented by formula (III) (tetramethinemerocyanine dye (I)/compound (III)), a ratio range of from 1/2 to 1/200 by weight is advantageously employed, with from 1/5 to 1/100 being particularly advantageous.

As the ratio of the cyan coupler of formula (II) to the compound represented by formula (III) (cyan coupler (II)/compound (III)), a mol ratio range of from 50 to 3,000 is advantageously employed.

The compound represented by formula (III) is preferably added to a silver halide emulsion in the same manner as the sensitizing dye (I), and the method of addition and the like may be the same as that for sensitizing dye (I).

In this occasion, the compound of formula (III) and the sensitizing dye of formula (I) may be added to an emulsion separately or as a mixture.

As the silver halide to be used in the emulsion of the present invention, any of silver chloride, silver bromide, silver iodide, silver chlorobromide, silver bromoiodide, silver chlorobromoiodide, etc., may be employed.

As a vehicle for the silver halide emulsion of the present invention, gelatin is usually used. In addition, those materials which do not exert harmful influences on light-sensitive silver halide, such as gelatin derivatives (e.g., acylated gelatin), albumin, agar-agar, gum arabi, alginic acid, hydrophilic resins (e.g., polyvinyl alcohol, polyvinylpyrrolidone, etc.), cellulose derivatives, etc., may be used in place of gelatin.

These silver halide grains may be coarse grains, fine grains, or a mixture thereof, and are prepared according to known processes, for example, a single jet process, a double jet process, or a controlled double jet process.

The silver halide grains may have a uniform crystal structure or a layered structure in which the inner portion and the outer portion have different properties, or may be of so-called conversion type as described in British Pat. No. 635,841 and U.S. Pat. No. 3,622,318. In addition, they may be of the type forming a latent image mainly on the surface thereof or of the type forming a latent image within the grains. These photographic emulsions can be prepared by generally employed various processes such as an ammoniacal process, a neutral process, and an acidic process, which are also described in such books as Mees, *The Theory of the Photographic Process*, 3rd Ed., 1966, published by Macmillan; Glafkides, *Photographic Chemistry*, published by Fountain Press; etc. After formation of these silver halide grains, they are washed with water for removing water-soluble salts formed as by-products (for example, potassium nitrate when silver bromide is formed by using silver nitrate and potassium bromide) from the system, followed by thermal treatment in the presence of a chemical sensitizing agent to raise sensitivity without coarsening the grains. The treatment may be effected without removal of the by-products of water-soluble salts. These general processes are described in the above-described books.

Mean diameter of the silver halide grains (measured by, for example, a projected area method to obtain a number-average value) preferably ranges from about 0.04 to about 4$\mu$.

In the step of forming silver halide grains, a silver halide solvent may be used for controlling the growth of the grains. Examples of the silver halide solvent include ammonia, potassium rhodanide, ammonium rhodanide, thioether compounds (e.g., those described in U.S. Pat. Nos. 3,271,157, 3,574,628, 3,704,130, 4,276,374, 4,297,439, etc.), thione compounds (e.g., those described in Japanese Patent Application (OPI) Nos. 144319/78, 82408/78, 77737/80, etc. (the term "OPI" as used herein refers to a "published unexamined Japanese patent application")), amine compounds (e.g., those described in Japanese Patent Application (OPI) No. 100717/79), etc.

To the silver halide photographic emulsion there may be applied conventionally employed chemical sensitization, such as gold sensitization (U.S. Pat. Nos. 2,399,083, 2,540,085, 2,597,876, 2,597,915, etc.), sensitization with a group VIII metal ion (U.S. Pat. Nos. 2,448,060, 2,540,086, 2,566,245, 2,566,263, 2,598,079, etc.), sulfur sensitization (U.S. Pat. Nos. 1,574,944, 2,278,947, 2,410,689, 2,440,206, 3,189,458, 3,415,649, etc.), reduction sensitization (U.S. Pat. Nos. 2,419,974, 2,518,698, 2,983,610, etc.), sensitization with a thioether compound (U.S. Pat. Nos. 2,521,926, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,574,709, 3,625,697, 3,635,717, 3,671,260, 4,198,240, etc.), or the combination thereof.

Examples of specific chemical sensitizing agents include sulfur sensitizing agents (e.g., allylthiocarbamide, thiourea, sodium thiosulfate, cystine, etc.), noble metal sensitizing agents (e.g., potassium chloroaurate, aurous thiosulfate, potassium chloropalladate, etc.), and reduction sensitizing agents (e.g., tin chloride, phenylhydrazine, reductone, etc.).

In addition, the photographic emulsion may contain such sensitizers as a polyoxyethylene derivative (British Pat. No. 981,470, Japanese Patent Publication No. 6475/56, U.S. Pat. No. 2,716,062, etc.), a polyoxypropylene derivative, a quaternary ammonium group-containing derivative, etc.

To the photographic emulsion of the present invention there may be added various compounds for the purpose of preventing reduction of sensitivity and formation of fog in the steps of producing, during storage, or during processing of, light-sensitive materials. As such compounds, a great number of compounds have long been known, such as certain heterocyclic compounds including nitrobenzimidazole, ammonium chloroplatinate, 4-hydroxy-6-methyl-1,3,3a,7-tetraazaindene, 3-methylbenzothiazole, and 1-phenyl-5-mercaptotetrazole, mercury-containing compounds, mercapto compounds, metal salts, etc. Some useful examples thereof are described in K. Mees, *The Theory of the Photographic Process,* 3rd Ed., 1966, pp. 344–349. Specific examples of the compounds are: thiazolium salts described in U.S. Pat. Nos. 2,131,038 and 2,694,716; azaindenes described in U.S. Pat. Nos. 2,444,605, 2,886,437, etc.; urazoles described in U.S. Pat. No. 3,287,135, etc.; sulfocatechols described in U.S. Pat. No. 3,236,652, etc.; oximes described in British Pat. No. 623,448, etc.; mercaptotetrazoles described in U.S. Pat. Nos. 2,403,927, 3,266,897. 3,397,987, etc.; nitron; nitroindazoles; polyvalent metal salts described in U.S. Pat. No. 2,839,405, etc.; thiuronium salts described in U.S. Pat. No. 3,220,839, etc.; and salts of palladium, platinum and gold described in U.S. Pat. Nos. 2,566,263, 2,587,915, etc.

A developing agent such as a hydroquinone; a catechol; an aminophenol, a 3-pyrazolidone; ascorbic acid or a derivative thereof; a reductone; a phenylenediamine; or a combination of these developing agents may be incorporated in the silver halide photographic emulsion. The developing agent may be incorporated in a silver halide emulsion layer and/or other photographic layer(s), for example, in a protective layer, an interlayer, a filter layer, an antihalation layer, a backing layer, etc. The developing agent may be added by dissolving in a suitable solvent or as a dispersion described in U.S. Pat. No. 2,592,368 or French Pat. No. 1,505,778.

Emulsion-hardening processing can be conducted in a conventional manner. Examples of the hardening agents include: aldehyde type compounds such as formaldehyde and glutaraldehyde; ketone compounds such as diacetyl, cyclopentanedione, etc.; reactive halogen-containing compounds such as bis(2-chloroethylurea), 2-hydroxy-4,6-dichloro-1,3,5-triazine, etc.; reactive olefin-containing compounds such as divinylsulfone, 5-acetyl-1,3-diacryloylhexahydro-1,3,5-triazine, etc.; N-methylol compounds such as N-hydroxymethylphthalimide and those described in U.S. Pat. Nos. 2,732,316, 2,586,168, etc.; isocyanates; aziridine compounds; acid derivatives; carbodiimide type compounds; epoxy compounds; isoxazole compounds; halogenocarboxyaldehydes such as mucochloric acid; dioxane derivatives such as dihydroxydioxane and dichlorodioxane; and inorganic hardeners such as chromium alum, zirconium sulfate, etc. In place of these compounds, their precursors such as alkali metal bisulfite-aldehyde adducts, hydantoin methylol derivatives, and primary aliphatic nitroalcohols may be used as well.

Surfactants may be added, alone or in combination, to a photographic emulsion of the present invention.

Surfactants are used as coating aids, but in some cases, may also serve other purposes, such as improvement of emulsion dispersion, improvement of photographic sensitization properties, antistatic purpose, prevention of adhesion, etc. The surfactants are grouped into: natural surfactants such as saponin; nonionic surfactants such as alkylene oxide derivatives, glycerin derivatives, glycidol derivatives, etc.; cationic surfactants such as higher alkylamines, quaternary ammonium salts, heterocyclic compounds (e.g., pyridine, etc.), phosphonium compounds, sulfonium compounds, etc.; anionic surfactants having an acidic group such as a carboxylic acid group, a sulfonic acid group, a phosphoric acid group, a sulfuric ester group, or a phosphoric ester group; and amphoteric surfactants such as amino acids, aminosulfonic acids, aminoalcohol sulfuric or phosphoric esters, etc.

Some examples of these usable surfactants are described in books such as Rhohei Oda et al., *Synthesis and Application of Surfactants* (Maki Shoten, 1964), A. W. Perry, *Surface Active Agents* (Interscience Publication Inc., 1958), J. P. Sisley, *Encyclopedia of Surface Active Agents,* Vol. 2 (Chemical Publish Company, 1964), and the like.

To the silver halide emulsion to be used in the present invention may be added, as a protective colloid, an acylated gelatin such as phthaloylated gelatin or malonoylated gelatin, a cellulose compound such as hydroxyethyl cellulose or carboxymethyl cellulose, soluble starch such as dextrin, or a hydrophilic polymer such as polyvinyl alcohol, polyvinylpyrrolidone, polyacrylamide or polystyrenesulfonic acid, a plasticizer for dimensional stability, latex polymer, and a matting agent. Specifically, those described in *Research Disclosure,* Vol. 176, RD-17643 (December 1978) can be used.

The silver halide photographic emulsion of the present invention may contain color couplers such as a cyan coupler, a magenta coupler, and a yellow coupler and compounds capable of dispersing the couplers.

That is, it may contain compounds capable of forming color by oxidative coupling with an aromatic primary amine developing agent (for example, a phenylenediamine derivative or an aminophenol derivative) in color development processing. For example, there are illustrated magenta couplers such as 5-pyrazolone couplers, pyrazolobenzimidazole couplers, cyanoacetylcoumarone couplers, open-chain acylacetonitrile couplers, etc., yellow couplers such as acylacetamide couplers (e.g., benzoylacetanilides, pivaloylacetanilides, etc.), etc., and cyan couplers such as naphthol couplers and phenol couplers. Of these couplers, non-diffusible couplers having a hydrophobic group called ballast group are desirable. The couplers may be of either the 4-equivalent type or 2-equivalent type with respect to silver ion. Colored couplers having color-correcting effect or couplers capable of releasing a development inhibitor upon development (called DIR couplers) may also be used.

In addition to DIR couplers, DIR coupling compounds capable of forming a colorless coupling reaction product and releasing a development inhibitor may also be incorporated.

Of the color couplers, magenta couplers of either 4- or 2-equivalent type may be particularly preferably incorporated, with 2-equivalent magenta couplers being more preferable.

Specific examples of magenta color-forming couplers are those described in U.S. Pat. Nos. 2,600,788, 2,983,608, 3,062,653, 3,127,269, 3,311,476, 3,419,391, 3,519,429, 3,558,319, 3,582,322, 3,615,506, 3,725,067, 3,770,447, 3,834,908, 3,891,445, British Pat. No. 1,047,612, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, 46223/81, 85748/81, 85749/81, 126833/81, Japanese Patent Application Nos. 136497/79, 23434/83 and 42671/83, etc.

Specific examples of yellow color-forming couplers are those described in U.S. Pat. Nos. 2,875,057, 3,265,506, 3,408,194, 3,551,155, 3,582,322, 3,725,072, and 3,891,445, West German Pat. No. 1,547,868, West German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, etc.

Specific examples of cyan couplers are those described in U.S. Pat. Nos. 2,369,929, 2,423,730, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, 90932/77, 109630/78, etc.

As colored couplers, those described, for example, in U.S. Pat. Nos. 2,521,908, 3,034,892, 3,476,560, Japanese Patent Publication Nos. 2016/69, 22335/63, 11304/67, 32461/69, Japanese Patent Application (OPI) Nos. 26034/76, 42121/77, West German Patent Application (OLS) No. 2,418,959, etc., can be used.

As the DIR couplers, those described in, for example, U.S. Pat. Nos. 3,227,554, 3,617,291, 3,632,345, 3,701,783, 3,790,384, West German Patent Application (OLS) Nos. 2,414,006, 2,454,301, 2,454,329, British Patent 953,454, Japanese Patent Application (OPI) Nos. 69624/77, 122335/74, and Japanese Patent Publication No. 16141/76 can be used.

In addition to the DIR couplers, those compounds which release a development inhibitor upon development may be incorporated in a light-sensitive material. For example, those described in U.S. Pat. Nos. 3,297,445, 3,379,529, West German Patent Application (OLS) No. 2,417,914, and Japanese Patent Application (OPI) Nos. 15271/77 and 9116/78 can be used.

The above-described couplers and the like may be used in combinations of two or more in one layer, or the same compound may be used in two or more layers for obtaining satisfactory properties required for a light-sensitive material.

The foregoing couplers include couplers having a water-soluble group such as a carboxyl group, a hydroxy group or a sulfo group and hydrophobic couplers. They are introduced into emulsions in a known manner of addition or dispersion. With hydrophobic couplers, a method of mixing with a high boiling organic solvent such as a phthalic ester, a trimellitic ester, a phosphoric ester or a fat oil or wax which is liquid at ordinary temperature and dispersing the resulting solution with the aid of an anionic surfactant described, for example, in U.S. Pat. Nos. 2,304,939, 2,322,027, etc., and a method of mixing with a low boiling organic solvent or a water-soluble organic solvent and dispersing the resulting solution as described, for example, in U.S. Pat. Nos. 2,801,170, 2,801,171, 2,949,360, etc., may be applied thereto. With couplers having a sufficiently low melting point (preferably 75° C. or lower), a method of dispersing them alone or together with couplers to be used in combination therewith, such as colored couplers, DIR couplers, or other couplers as described, for example, in German Pat. No. 1,143,707, may be applied. Water-soluble couplers may be added to an emulsion as an alkaline solution or together with a hydrophobic coupler which is used as an aid for dispersing (or as an anionic surfactant).

In addition, color images may be formed by developing with a color developer containing a diffusible coupler.

As irradiation-preventing agents to be incorporated depending upon the end-use, those described in, for example, Japanese Patent Publication Nos. 20389/66, 3504/68, 13168/68, U.S. Pat. Nos. 2,697,037, 3,423,207, 2,865,752, British Pat. Nos. 1,030,392, 1,100,546, etc., may be used.

The present invention may be applied to sensitization of silver halide emulsions for use in various color light-sensitive materials. Examples of such emulsions include emulsions for obtaining color positives, emulsions for color paper, emulsions for obtaining color negatives, emulsions for use in color reversal process.

Exposure for obtaining a photographic image may be conducted in a conventional manner. That is, any of various known light sources such as a natural light (sunlight), tungsten lamp, fluorescent lamp, mercury lamp, xenon arc lamp, flying spots on a cathode ray tube, etc., may be used. As to exposure time, an exposure time of 1/1,000 second to 1 second employed for an ordinary camera, an exposure time shorter than 1/1,000 second (for example, $1/10^4$–$1/10^6$ second exposure using a xenon flash lamp or cathode ray tube), and an exposure time longer than 1 second may be employed. If necessary, the spectral composition of light rays to be used for exposure may be adjusted by using a color filter. In addition, laser light or light emitted from a fluorescent body excited by an electron beam, X-rays, gamma rays, alpha rays, etc., may be employed.

Stratum structure of a multilayered color light-sensitive material to which the present invention is applicable is not particularly limited; for example, blue-sensitive layer (B), green-sensitive layer (G), and red-sensitive layer (R) may be coated in the listed order from the side near support, with the order of (R), (G) and (B) or the order of (B), (R) and (G) being employable as well. With the order of (R), (G) and (B), a yellow filter is desirably used between (G) and (B).

The silver halide photographic emulsion of the present invention is coated on a support together with, if necessary, other photographic layers. That is, the emulsion may be coated according to various coating methods including a dip coating method, an air knife coating method, a curtain coating method, and an extrusion coating method using a hopper described in U.S. Pat. No. 2,681,294.

If necessary, two or more layers may be simultaneously coated by methods as described in U.S. Pat. Nos. 2,761,791, 3,508,947, etc.

As the support, flat substances which do not undergo serious dimensional charge during processing are preferable. Examples include hard supports and flexible supports which are selected depending upon the intended end-use. Typical flexible supports include a cellulose nitrate film, a cellulose acetate film, a cellulose acetate butyrate film, a cellulose acetate propionate film, a polyethylene terephthalate film, paper, etc., which are commonly used for photographic light-sensitive materials. Papers coated or laminated with baryta or α-olefin polymer (particularly polymer of α-olefin having 2 to 10 carbon atoms, such as polyethylene, polypropylene, ethylene/butene copolymer, etc.) and plastic films whose surface has been made rough to improve intimate adhesive properties with other polymer substance and raise printability as described in Japanese Patent Publication No. 19068/72 can also provide good results.

Opaque supports include essentially opaque supports such as paper, and in addition, those prepared by adding dyes or pigments like titanium oxide to a transparent film, plastic films having been surface-treated according to the process described in Japanese Patent Publication No. 19068/72, papers or plastic films to which carbon black, dye, or the like has been added to completely cut light, and the like. Where adhesion force between the support and the photographic emulsion layer is insufficient, an adhesive layer which is adhesive to both the support and the photographic emulsion layer is provided as a subbing layer. Also, in order to more improve the adhesion properties, the surface of the support may be subjected to such preliminary treatment as corona discharge treatment, etc.

The silver halide photographic emulsion of the present invention is subjected to color development using an aromatic primary amine compound such as a p-phenylenediamine derivative. Typical examples of the color developing agent include inorganic acid salts of N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl)amino]aniline, 3-methyl-4-amino-N-ethyl-N-(β-hydroxyethyl)aniline, etc., 4-amino-3-methyl-N-ethyl-N-(β-methanesulfonamidoethyl)aniline sesquisulfate monohydrate described in U.S. Pat. No. 2,193,015, N-(2-amino-5-diethylaminophenylethyl)methanesulfonamide sulfate described in U.S. Pat. No. 2,592,364, N,N-dimethyl-p-phenylenediamine hydrochloride, 3-methyl-4-amino-N-ethyl-N-methoxyethylaniline described in Japanese Patent Application (OPI) No. 64933/73, and the like.

These color developing agents are described in detail in L. F. A. Mason, *Photographic Processing Chemistry,* Focal Press, London, 1966, pp. 226–229, etc. They may be used in combination with 3-pyrazolidones.

Various additives may be added to a color developing solution as the occasion demands.

Typical examples of additives include alkali agents (e.g., hydroxides, carbonates and phosphates of alkali metals or ammonium, etc.), pH adjusting or buffering agents (e.g., weak acids such as acetic acid and boric acid, weak bases, salts thereof, etc.), development accelerators (e.g., various pyridinium compounds and cationic compounds described in U.S. Pat. Nos. 2,648,604, 3,671,247, etc., potassium or sodium nitrate, polyethylene glycol condensates and the derivatives thereof as described in U.S. Pat. Nos. 2,533,990, 2,577,127, 2,950,970, etc., nonionic compounds such as polythioethers as described in British Pat. Nos. 1,020,033 and 1,020,032, polymer compounds having sulfite ester as represented by the compounds described in U.S. Pat. No. 3,068,097, amines such as pyridine and ethanolamine, benzyl alcohol, hydrazines, etc.), antifogging agents (e.g., alkali bromides, alkali iodides, nitrobenzimidazoles described in U.S. Pat. Nos. 2,496,940 and 2,656,271, mercaptobenzimidazole, 5-methylbenzotriazole, 1-phenyl-5-mercaptotetrazole, compounds for rapid processing described in U.S. Pat. Nos. 3,113,864, 3,295,976, 3,342,596, 3,597,199, 3,615,522, etc., thiosulfonyl compounds described in British Pat. No. 972,211, phenazine-N-oxides as described in Japanese Patent Publication No. 41675/71, and those described in *Kagaku Shashin Binran,* Vol. II, pp. 29–47), stain or sludge-preventing agents described in U.S. Pat. Nos. 3,161,513 and 3,161,514, British Pat. Nos. 1,030,442, 1,144,481, 1,251,558, etc., interimage effect-accelerating agents as described in U.S. Pat. No. 3,536,487, etc., and preservatives (e.g., sulfites, acid sulfites, hydroxylamine hydrochloride, formsulfite, alkanolamine-sulfite adduct, etc.).

After development processing, the silver halide photographic emulsion of the present invention is fixed in a conventional manner, and if desired, bleach processing is also effected. The bleaching may be conducted simultaneously with, or separately from, the fixing. Where bleaching and fixing are conducted simultaneously, the light-sensitive material is processed in a bleach-fixing bath containing both a bleaching agent and a fixing agent. As bleaching agents, many known compounds can be used. Of them, ferricyanides, dichromates, water-soluble cobalt (III) salts, water-soluble copper (II) salts, water-soluble quinones, nitrosophenols, and compounds of polyvalent metals such as iron (III), cobalt (III), copper (II), etc. (particularly, complexes between the polyvalent metal cation and an organic acid such as metal complexes of aminopolycarboxylic acid (e.g., ethylenediaminetetraacetic acid, nitrilotriacetic acid, iminodiacetic acid, N-hydroxyethylethylenediaminetriacetic acid, etc.), malonic acid, tartaric acid, malic acid, diglycollic acid, dithioglycollic acid, etc., and 2,6-dipicolinic acid-copper complex), peracids (e.g., alkyl peracids, persulfates, permanganates, hydrogen peroxide), hypochlorites, chlorine, bromine, bleaching powder, etc., are generally used alone or in proper combination. Bleaching, fixing, and bleach-fixing are described in detail in U.S. Pat. No. 3,582,322, etc. To the processing solution may be further added various additives including bleaching accelerators as described in U.S. Pat. Nos. 3,042,520 and 3,241,966, Japanese Patent Publication Nos. 8506/70, 8836/70, etc.

In order to prevent inhibition of spectral sensitization caused by the copresence of color coupler, hitherto, it has been proposed to bind a sulfo group of the color coupler to a sensitizing dye. However, some of the conventional pentamethinecyanines having one sulfo group fail to fully prevent the action of inhibiting spectral sensitization by cyan couplers of formula (II). This inhibition action can now be prevented by using the sensitizing dyes represented by formula (I).

In addition, combined use of the compound of formula (III) and the sensitizing dye (I) serves to prevent stain by color development.

The present invention will now be described in more detail below by reference to examples, which, however, are not to be construed as limiting the present invention in any way.

EXAMPLE 1

On a cellulose triacetate support were coated, in sequence, the following first layer (lowermost layer) to the sixth layer (uppermost layer) to obtain multilayered color light-sensitive film samples (Samples 1 to 12) as shown in Table 1. (In Table 1, mg/m$^2$ stands for a coating amount.)

TABLE 1

| | | |
|---|---|---|
| Sixth Layer: (protective layer) | Gelatin | 750 mg/m$^2$ |
| Fifth Layer: (green-sensitive layer) | AgClBr emulsion (AgBr: 30 mol %; Ag: 500 mg/m$^2$) | |
| | Gelatin | 1,300 mg/m$^2$ |
| | Potassium bromide | 5 mg/m$^2$ |
| | Sensitizing dye (*1) | 2.1 mg/m$^2$ |
| | Magenta coupler (*2) | 600 mg/m$^2$ |
| | Coupler solvent (*3) | 110 mg/m$^2$ |
| Fourth Layer: | Gelatin | 500 mg/m$^2$ |
| Third Layer: (red-sensitive layer) | AgClBr emulsion (AgBr: 30 mol %; Ag: 500 mg/m$^2$) | |
| | Gelatin | 2,900 mg/m$^2$ |
| | Sensitizing dye (*4) | See Table 2. |
| | Cyan coupler (*5) | " |
| | Coupler solvent (*6) | 700 mg/m$^2$ |
| Second Layer: | Gelatin | 500 mg/m$^2$ |
| First Layer: (blue-sensitive layer) | AgBrI emulsion (AgI: 0.2 mol %; Ag: 1,000 mg/m$^2$) | |
| | Gelatin | 2,200 mg/m$^2$ |
| | Sensitizing dye (*7) | 2.0 mg/m$^2$ |
| | Yellow coupler (*8) | 1,200 mg/m$^2$ |
| | Coupler solvent (*9) | 600 mg/m$^2$ |

TABLE 1-continued

Support: Cellulose triacetate (*1):

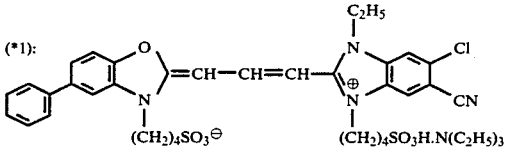

(*2): Magenta coupler: 3-[(2-Chloro-5-tetradecanamido)anilino]-1-(2,4,6-trichlorophenyl)-2-pyrazolin-5-one (*3): Coupler solvent: Cresyl phosphate (*4): Sensitizing dye: According to the formulation of Samples 1 to 12 given in Table 2.

(*5): Cyan coupler: According to the formulation of Samples 1 to 12 given in Table 2.

(*6): Coupler solvent: Dibutyl phthalate (60 wt %) and 2,4-di-tert-amylphenol (40 wt %)

(*7): Sensitizing dye: 3-Phenyl-5-[3-(3-sulfopropyl)-2-benzoxazolinylidene]rhodanine sodium salt (*8): Yellow coupler: α-(4-Methoxybenzoyl)-α-(3-benzyl-4-ethoxy-hydantoin-1-yl)-2-chloro-5-dodecyloxycarbonyl-acetanilide (*9): Coupler solvent: Dibutyl phthalate As shown in Table 2 below, sensitizing dye of the present invention represented by formula (I), cyan coupler represented by formula (II), and a compound represented by formula (III) or a comparative compound were added to the third layer to prepare Samples 1 to 27. Part of each sample was stored at room temperature for 2 days, and the rest of each sample was stored under conditions of high temperature and high humidity (50° C., 80% RH) for 2 days. Each sample was exposed to blue light, red light and green light through a continuous wedge, followed by development processing to evaluate sensitivity to red light, color mixing of cyan color image with magenta color image, i.e., sensitization by diffusion into adjacent layer, and fog. The results thus obtained are shown in Table 2.

| Development Processing Steps: | | | |
|---|---|---|---|
| Color Development | 36° C. | 3 min | |
| Stopping | 36° C. | | 40 sec |
| First Fixing | 36° C. | | 40 sec |
| Bleaching | 36° C. | 1 min | |
| Second Fixing | 36° C. | | 40 sec |
| Washing with Water | 30° C. | | 30 sec |

| Formulation of Color Developer: | |
|---|---|
| Sodium Sulfite | 5 g |
| 4-Amino-3-methyl-N,N—diethylaniline | 3 g |
| Sodium Carbonate | 20 g |
| Potassium Bromide | 2 g |
| Water to make | 1 liter (pH 10.5) |

| Formulation of Stopping Solution: | |
|---|---|
| Sulfuric Acid (6 N) | 50 ml |
| Water to make | 1 liter (pH 1.0) |

| Formulation of Fixing Solution: | |
|---|---|
| Ammonium Thiosulfate | 60 g |
| Sodium Sulfite | 2 g |
| Sodium Hydrogensulfite | 10 g |
| Water to make | 1 liter (pH 5.8) |

| Formulation of Bleaching Solution: | |
|---|---|
| Potassium Ferricyanide | 30 g |
| Potassium Bromide | 15 g |
| Water to make | 1 liter (pH 6.5) |

TABLE 2

| Sample No. | Compound I Amount Added ($\times 10^{-7}$ mol/m$^2$) | | Compound II Amount Added (g/m$^2$) | | Compound III Amount Added (mg/m$^2$) | | Realative Sensitivity | Development Fog | Density* ($D_G$) Owing to Sensitization by Diffusion into Adjacent Layer *1 | *2 |
|---|---|---|---|---|---|---|---|---|---|---|
| 1 (for comparison) | (*S-1) | 3.45 | II-3 | 1.50 | — | | 41 | 0.07 | 0.03 | 0.05 |
| 2 (for comparison) | " | 3.45 | " | 1.50 | III-6 | 7.8 | 43 | 0.06 | 0.03 | 0.06 |
| 3 | " | 5.18 | " | 1.50 | " | 7.8 | 40 | 0.06 | 0.04 | 0.07 |
| 4 | I-11 | 3.45 | " | 1.50 | — | | 92 | 0.07 | 0.02 | 0.02 |
| 5 | " | 3.45 | " | 1.50 | III-6 | 7.8 | 100 | 0.05 | 0.03 | 0.03 |
| 6 | " | 5.18 | " | 1.50 | " | 7.8 | 121 | 0.05 | 0.04 | 0.05 |
| 7 (for comparison) | (*S-2) | 3.45 | " | 1.60 | — | | 101 | 0.10 | 0.10 | 0.35 |
| 8 (for comparison) | " | 3.45 | " | 1.60 | III-6 | 7.8 | 111 | 0.06 | 0.12 | 0.36 |
| 9 | " | 5.18 | " | 1.60 | " | 7.8 | 126 | 0.07 | 0.24 | 0.58 |
| 10 | I-5 | 3.45 | II-1 | 1.60 | — | | 105 | 0.08 | 0.02 | 0.04 |
| 11 | " | 3.45 | " | 1.60 | III-6 | 7.8 | 115 | 0.04 | 0.03 | 0.03 |
| 12 | " | 5.18 | " | 1.60 | " | 7.8 | 134 | 0.05 | 0.03 | 0.04 |
| 13 | " | 3.45 | II-1 + *C-1 | 1.30 0.25 | — | | 101 | 0.09 | 0.04 | 0.05 |
| 14 | " | 3.45 | II-1 + *C-1 | 1.30 0.25 | III-6 | 7.8 | 108 | 0.06 | 0.03 | 0.05 |
| 15 | " | 5.18 | II-1 + *C-1 | 1.30 0.25 | " | 7.8 | 140 | 0.07 | 0.04 | 0.06 |
| 16 | I-12 | 3.45 | II-11 | 1.50 | — | | 89 | 0.08 | 0.03 | 0.04 |
| 17 | " | 3.45 | " | 1.50 | III-10 | 7.5 | 101 | 0.07 | 0.03 | 0.04 |
| 18 | " | 5.18 | " | 1.50 | " | 7.5 | 120 | 0.07 | 0.04 | 0.04 |
| 19 | I-18 | 3.45 | II-19 | 1.65 | — | | 103 | 0.09 | 0.03 | 0.04 |
| 20 | " | 3.45 | " | 1.65 | III-12 | 8.0 | 115 | 0.07 | 0.03 | 0.03 |
| 21 | " | 5.18 | " | 1.60 | " | 8.0 | 137 | 0.08 | 0.04 | 0.04 |
| 22 | I-24 | 3.45 | II-25 | 1.45 | — | | 100 | 0.08 | 0.04 | 0.05 |
| 23 | " | 3.45 | " | 1.45 | III-6 | 7.8 | 108 | 0.05 | 0.03 | 0.04 |
| 24 | " | 5.18 | " | 1.45 | " | 7.8 | 126 | 0.06 | 0.03 | 0.05 |
| 25 | I-27 | 3.45 | II-38 | 1.50 | — | | 85 | 0.07 | 0.04 | 0.06 |
| 26 | " | 3.45 | " | 1.50 | III-13 | 8.8 | 98 | 0.05 | 0.04 | 0.06 |
| 27 | " | 5.18 | " | 1.50 | " | 8.8 | 115 | 0.05 | 0.04 | 0.06 |

*1 After storing at room temperature
*2 After storing at high temperature and high humidity (50° C., 80% RH) for 2 days
*S-1:

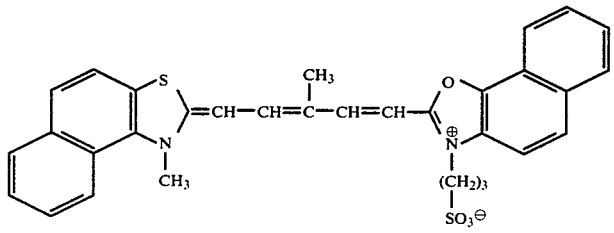

*S-2:

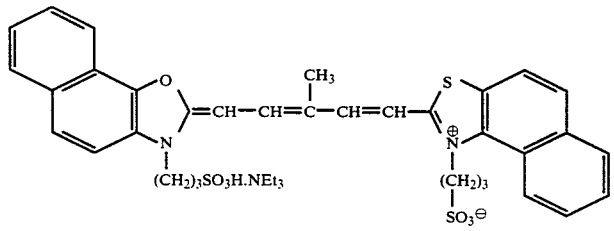

*C-1: 2-[α-(2,4-di-tert-pentylphenoxy)butanamido]-4,6-dichloro-5-methylphenol

Additionally, details of sensitization by diffusion into an adjacent layer are as follows. That is, it was evaluated in terms of an optical density of magenta coloration image, $D_G$, obtained by an exposure amount giving a maximum optical density, $D_{max}$, of cyan color image in red light-struck portions. The smaller the $D_G$ value, the smaller the sensitization by diffusion, thus smaller $D_G$ being preferable.

As is clear from the results shown in Table 2, in comparison with comparative samples (Sample Nos. 1–3 and 7–9), combinations of the present invention (Sample Nos. 4–6 and 10–27) provided excellent light-sensitive materials causing less sensitization by diffusion into the adjacent layer even after storage under the conditions of high temperature and high humidity, with providing enough sensitivity and fully preventing development fog, or stain by color development.

EXAMPLE 2

On a paper support double laminated with polyethylene were coated, in sequence, the following first layer (undermost layer) to the sixth layer (uppermost layer) to prepare a color photographic light-sensitive material (Sample 28). In Table 3, mg/m$^2$ indicates the coating amount.

TABLE 3

| | | |
|---|---|---|
| Sixth Layer: (protective layer) | Gelatin | 1,600 mg/m$^2$ |
| Fifth Layer: (red-sensitive layer) | AgClBr emulsion (AgBr: 50 mol %; Ag: 300 mg/m$^2$) | |
| | Sensitizing dye (*1) | 0.05 mg/m$^2$ |
| | Cyan coupler (*2) | 400 mg/m$^2$ |
| | Coupler solvent (*3) | 300 mg/m$^2$ |
| | Gelatin | 500 mg/m$^2$ |
| Fourth Layer: (UV ray-absorbing layer) | UV ray absorbent (*4) | 600 mg/m$^2$ |
| | Solvent for UV ray absorbent (*3) | 300 mg/m$^2$ |
| | Gelatin | 800 mg/m$^2$ |
| Third Layer: (green-sensitive layer) | AgClBr emulsion (AgBr: 70 mol %; Ag: 500 mg/m$^2$) | |
| | Magenta coupler (*5) | 400 mg/m$^2$ |
| | Antifading agent (*6) | 200 mg/m$^2$ |
| | Coupler solvent (*7) | 400 mg/m$^2$ |
| | Gelatin | 700 mg/m$^2$ |
| Second Layer: (interlayer) | Gelatin | 1,000 mg/m$^2$ |
| First Layer: (blue-sensitive layer) | AgClBr emulsion (AgBr: 80 mol %; Ag: 400 mg/m$^2$) | |
| | Yellow coupler (*8) | 500 mg/m$^2$ |
| | Coupler solvent (*3) | 400 mg/m$^2$ |
| | Gelatin | 700 mg/m$^2$ |
| Support: | Polyethylene double laminated paper | |

*1: Sensitizing dye*

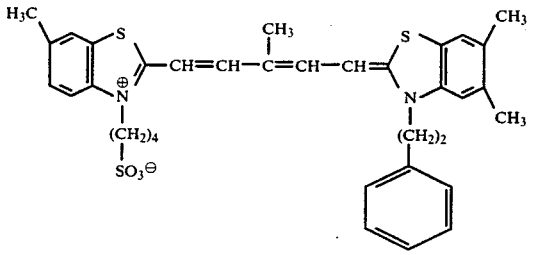

*2: Coupler:
2-[α-(2,4-Di-tert-pentylphenoxy)butanamido]-4,6-dichloro-5-methylphenol
*3: Solvent:
Trinonyl phosphate
*4: UV ray absorbent:
2-(2-Hydroxy-3-sec-butyl-5-tert-butylphenol)-benzotriazole
*5: Coupler:
1-(2,4,6-Trichlorophenyl)-3-(2-chloro-5-tetradecanamido)anilino-2-pyrazolon-5-one
*6: Antifading agent:
2,5-Di-tert-hexylhydroquinone
*7 Solvent:
Tricresyl phosphate
*8: Coupler:
α-Pivaloyl-α-(2,4-dioxy-5,5'-dimethyloxazolidin-3-yl)-2-chloro-5-[-(2,4-di-tert-phenyloxy)-butanamido]acetanilide The sensitizing dye in the red-sensitive layer of the sample was changed as given in Table 4 and each compound represented by formula (III) was added as also shown in Table 4 to prepare Samples 29 to 37. Part of each sample was stored at room temperature (25° C.) for 2 days, and the rest of each sample under the conditions of high temperature and high humidity (50° C., 80% RH) for 2 days. Then, each sample was exposed to red light through a continuous wedge, then developed according to the following processing steps.

| | | |
|---|---|---|
| Processing Steps: | | |
| Color Development | 33° C. | 3 min 30 sec |
| Bleach-Fixing | 33° C. | 1 min 30 sec |
| Washing with Water | 30° C. | 3 min |
| Drying | | |
| Formulation of Color Developer: | | |
| Benzyl Alcohol | | 15 ml |
| Sodium Sulfite | | 5 g |
| Potassium Bromide | | 0.4 g |
| Hydroxylamine Sulfate | | 2 g |
| 4-(N—Ethyl-N—β-methanesulfonamido)-2-methylaniline Sesquisulfate | | 2 g |
| Sodium Carbonate (monohydrate) | | 30 g |
| Water to make | | 1,000 ml pH 10.1 |
| Formulation of Bleach-Fixing Solution: | | |
| Fe (III) Ethylenediaminetetraacetate | | 45 g |
| 70 wt % Aq. Soln. of Ammonium Thiosulfate | | 160 g |
| Sodium Sulfite | | 10 g |
| Tetrasodium Ethylenediaminetetraacetate | | 5 g |
| Water to make | | 1,000 ml pH 6.8 |

Color density of each of the thus developed samples was measured. Fog, sensitivity, and gamma of each sample are tabulated in Table 5.

TABLE 4

| Sample No. | Compound (I) Amount added (mg/m$^2$) | | Comound (II) Amount added (mg/m$^2$) | | Compound (III) Amount added (mg/m$^2$) | Notes |
|---|---|---|---|---|---|---|
| 28 | (*1) in Table 3 | 0.050 | (*2) in Table 3 | 400 | — | Comparative sample |
| 29 | (*1) in Table 3 | 0.050 | (*2) in Table 3 | 400 | III-6 3.00 | Comparative sample |
| 30 | (*1) in Table 3 | 0.050 | II-1 | 530 | — | Comparative sample |
| 31 | (*1) in Table 3 | 0.050 | II-1 | 530 | III-6 3.00 | Comparative sample |
| 32 | I-5 | 0.041 | II-1 | 530 | — | Sample of the invention |
| 33 | I-5 | 0.041 | II-1 | 530 | III-6 3.00 | Sample of the invention |
| 34 | I-5 | 0.041 | II-3 | 500 | — | Sample of the invention |
| 35 | I-5 | 0.041 | II-3 | 500 | III-6 3.00 | Sample of the invention |
| 36 | I-11 | 0.038 | II-1 | 530 | — | Sample of the invention |
| 37 | I-11 | 0.038 | II-1 | 530 | III-6 3.00 | Sample of the invention |

TABLE 5

| Sample No. | After Storing at Room Temperature Fog | Sensitivity | Gamma | Storing for 2 Days at 50° C., 80% RH Fog | Sensitivity | Gamma | Notes |
|---|---|---|---|---|---|---|---|
| 28 | 0.14 | 1.15 | 2.78 | 0.15 | 0.88 | 2.56 | Comparative sample |
| 29 | 0.12 | 1.25 | 2.86 | 0.14 | 1.00 | 2.63 | Comparative sample |
| 30 | 0.13 | 1.06 | 2.86 | 0.14 | 0.78 | 2.56 | Comparative sample |
| 31 | 0.12 | 1.14 | 2.94 | 0.14 | 0.92 | 2.56 | Comparative sample |
| 32 | 0.13 | 1.26 | 2.86 | 0.14 | 1.19 | 2.78 | Present invention |
| 33 | 0.11 | 1.33 | 2.94 | 0.12 | 1.30 | 2.86 | Present invention |
| 34 | 0.13 | 1.25 | 2.78 | 0.14 | 1.18 | 2.70 | Present invention |
| 35 | 0.11 | 1.30 | 2.78 | 0.12 | 1.28 | 2.78 | Present invention |
| 36 | 0.13 | 1.22 | 3.03 | 0.14 | 1.15 | 2.94 | Present invention |
| 37 | 0.11 | 1.29 | 3.03 | 0.12 | 1.27 | 2.94 | Present invention |

As is seen from Table 5, comparative samples (Sample Nos. 28–31) suffered serious desensitization when p-phenylenediamine type coupler was used as cyan coupler, and desorption of the sensitizing dye took place after storage under the conditions of high temperature and high humidity, resulting in undesirably low sensitivity and low contrast tone. On the other hand, samples of the present invention (Sample Nos. 32 to 37) suffered no desensitization even when p-phenylenediamine type cyan coupler was used, and substantially prevented desensitization and low contrast tone even after storage under conditions of high temperature and high humidity. The combined use of the compound of formula (III) therewith served to significantly depress development fog.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing in combination at least one sensitizing dye represented by formula (I) and at least one cyan coupler represented by formula (II):

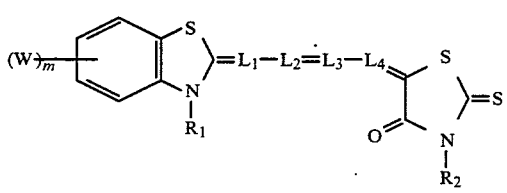

(I)

wherein W represents a halogen atom, an unsubstituted or substituted alkyl group, an unsubstituted or substituted aryl group, a hydroxyl group, an unsubstituted or substituted alkoxy group, an unsubstituted or substituted aryloxy group, an acyl group, an acyloxy group, an unsubstituted or substituted alkoxycarbonyl group, a carbamoyl group, a sulfamoyl group, a carboxyl group, or an unsubstituted or substituted benzo group; $L_1$, $L_2$, $L_3$, and $L_4$ each represents an unsubstituted or substituted methine group; $R_1$ represents an unsubstituted or substituted alkyl group; $R_2$ represents an unsubstituted or substituted alkyl group, an unsubstituted or substituted aryl group or a heterocyclic group; provided that at least one of $R_1$ and $R_2$ represents a substituted alkyl group containing a sulfo group or a carboxyl group; and m represents 0, 1, or 2;

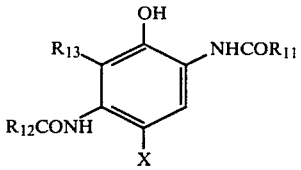

(II)

wherein $R_{11}$ and $R_{12}$ each represents an alkyl group, an aryl group, a heterocyclic group, an alkyloxy group, an aryloxy group, a heterocyclyloxy group, an alkylamino group, an arylamino group or a heterocyclylamino group; $R_{13}$ represents a hydrogen atom, a halogen atom, an alkyl group, an aryl group, an alkoxy group, an aryloxy group, an acyloxy group or an acylamino group; or $R_{12}$ and $R_{13}$ may be connected to each other to form a 5- or 6-membered ring; and X represents a group capable of being eliminated upon an oxidative coupling reaction with a developing agent.

2. A silver halide photographic emulsion as in claim 1 containing, in addition to the sensitizing dye (I) and the cyan coupler (II), at least one compound represented by formula (III)

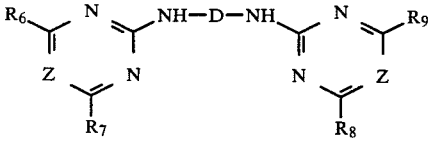

(III)

wherein D represents a divalent aromatic residue; Z represents —CH= or —N=; $R_6$, $R_7$, $R_8$, and $R_9$ each represents a hydrogen atom, a hydroxyl group, an alkoxy group, an aryloxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group.

3. A silver halide photographic emulsion as in claim 1, wherein the sensitizing dye represented by formula (I) is used in an amount of from about $2\times10^{-5}$ to $2\times10^{-3}$ mol per mol of silver halide in the emulsion.

4. A silver halide photographic emulsion as in claim 1, wherein the cyan coupler represented by formula (II) is used in an amount of from about $1\times10^{-3}$ to $7\times10^{-1}$ mol per mol of silver halide in the emulsion.

5. A silver halide photographic emulsion as in claim 1, wherein the ratio of the sensitizing dye represented by formula (I) to the cyan coupler represented by formula (II) is from $1/6\times10^{4}$ to 2/1,000 by mol.

6. A silver halide photographic emulsion as in claim 2, wherein the compound represented by formula (III) is used in an amount of from about 0.01 g to 5 g per mol of silver halide in the emulsion.

7. A silver halide photographic emulsion as in claim 2, wherein the ratio of the sensitizing dye represented by formula (I) to the compound represented by formula (III) is from 1/2 to 1/200 by weight.

8. A silver halide photographic emulsion as in claim 2, wherein the ratio of the cyan coupler represented by formula (II) to the compound represented by formula (III) is from 50 to 3,000 by mol.

9. A silver halide photographic emulsion as in claim 1, wherein the sensitizing dye represented by formula (I) is a compound having the following formula I-5, I-6, I-7, I-11, I-12, I-13 or I-18:

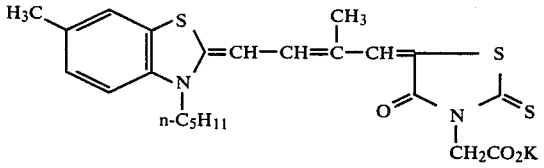

I-5

-continued

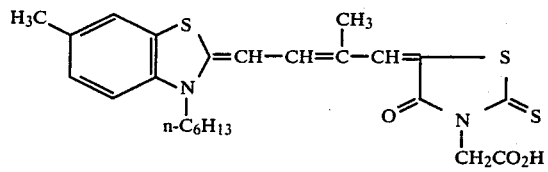

I-6

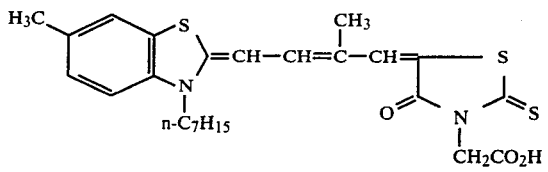

I-7

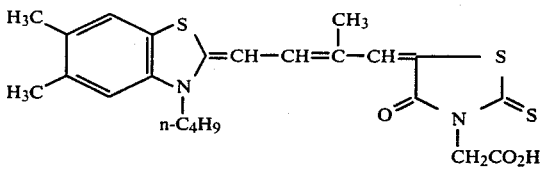

I-11

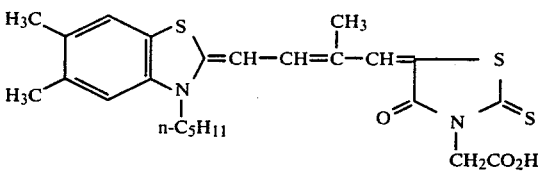

I-12

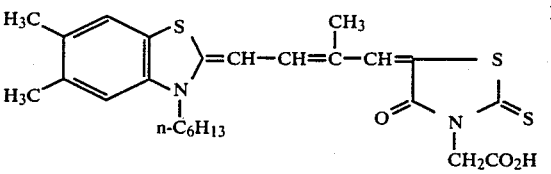

I-13

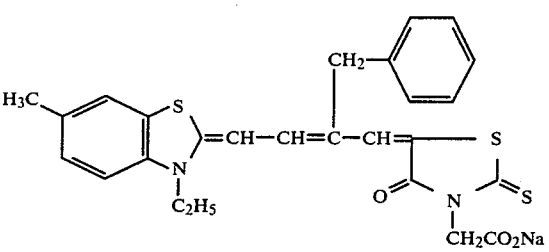

I-18

* * * * *